US008382571B2

(12) United States Patent
Fujimori et al.

(10) Patent No.: US 8,382,571 B2
(45) Date of Patent: Feb. 26, 2013

(54) GAMING SYSTEM WITH COMMON DISPLAY AND CONTROL METHOD OF GAMING SYSTEM

(75) Inventors: Kenichi Fujimori, Tokyo (JP); Arata Ajiro, Tokyo (JP); Tsuyoshi Ohira, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1184 days.

(21) Appl. No.: 12/212,215

(22) Filed: Sep. 17, 2008

(65) Prior Publication Data

US 2009/0239622 A1 Sep. 24, 2009

Related U.S. Application Data

(60) Provisional application No. 61/038,499, filed on Mar. 21, 2008.

(51) Int. Cl.
*A63F 9/24* (2006.01)

(52) U.S. Cl. ..... 463/20; 463/16; 463/25; 463/42; 463/43

(58) Field of Classification Search ..... 463/16, 463/20, 25, 42, 43
See application file for complete search history.

(56) References Cited

U.S. PATENT DOCUMENTS 4,804,185 A * 2/1989 Noble et al. ..... 463/11
5,820,459 A 10/1998 Acres et al.
5,924,926 A * 7/1999 Brown ..... 463/11
6,287,194 B1 * 9/2001 Okada et al. ..... 463/16
6,695,697 B1 2/2004 Okada
6,780,105 B1 * 8/2004 Kaminkow ..... 463/16
7,008,324 B1 * 3/2006 Johnson et al. ..... 463/42
7,431,297 B2 * 10/2008 Kaji et al. ..... 273/237
7,789,756 B2 * 9/2010 Jones et al. ..... 463/37
2001/0004607 A1 * 6/2001 Olsen ..... 463/26
2003/0073486 A1 4/2003 Okada
2004/0053662 A1 * 3/2004 Pacey ..... 463/16
2004/0116175 A1 * 6/2004 Aida ..... 463/16
2004/0180722 A1 * 9/2004 Giobbi ..... 463/42
2005/0282629 A1 * 12/2005 Gagner ..... 463/31
2006/0040730 A1 * 2/2006 Walker et al. ..... 463/20
2006/0046821 A1 * 3/2006 Kaminkow et al. ..... 463/16
2006/0121971 A1 * 6/2006 Slomiany et al. ..... 463/16
2007/0021201 A1 * 1/2007 Matsumoto ..... 463/30
2007/0060247 A1 * 3/2007 Low et al. ..... 463/16
2007/0060277 A1 * 3/2007 Okada ..... 463/17

(Continued)

*Primary Examiner* — William Brewster
*Assistant Examiner* — Jason Skaarup
(74) *Attorney, Agent, or Firm* — KMF Patent Services, PLLC; Kenneth M. Fagin, Esq.

(57) ABSTRACT

A gaming system of the present invention includes: a plurality of gaming machines; and a common display device connected to the gaming machines; wherein each of the gaming machines has: a display device, which displays a plurality of symbols; a controller, which executes a process of rearranging symbols arranged on the display device, after a gaming medium is betted, and executing a first game of making a payment according to the rearranged symbols and a process of transferring to a second game which is different from the first game while it is triggered that a predetermined condition is met; a communication interface, which notifies an execution state of the second game to the common display device, and the common display device has: a communication interface, which receives notification from each of the gaming machine; a memory, which stores an effect image relating to the second game and an explanatory image explaining contents of the second game; and a control, which executes a process of judging whether or not the second game is started at each of the gaming machines, based upon the notification from each of the gaming machines, a process of displaying the explanatory image stored in the memory while the second game is started at each of the gaming machines, and process of displaying an effect image stored in the memory in place of the explanatory image.

5 Claims, 22 Drawing Sheets

U.S. PATENT DOCUMENTS

2007/0060279 A1* 3/2007 Okada et al. ..... 463/17
2007/0082725 A1* 4/2007 Low et al. ..... 463/16
2007/0178958 A1* 8/2007 Inamura ..... 463/17
2008/0096659 A1* 4/2008 Kreloff et al. ..... 463/39
2008/0108401 A1* 5/2008 Baerlocher et al. ..... 463/12
2008/0108425 A1* 5/2008 Oberberger ..... 463/25
2010/0234094 A1* 9/2010 Gagner et al. ..... 463/20

* cited by examiner

FIG.4

| | PAY TABLE | | | 1BET | 2BET | MAX(3)BET |
|---|---|---|---|---|---|---|
| 1 | DOUBLE | DOUBLE | DOUBLE | 800 | 1600 | 2400 |
| 2 | DOUBLE | DOUBLE | 3BAR | 240 | 480 | 720 |
| 3 | DOUBLE | 3BAR | 3BAR | 120 | 240 | 360 |
| 4 | 3BAR | 3BAR | 3BAR | 60 | 120 | 180 |
| 5 | DOUBLE | DOUBLE | 2BAR | 120 | 240 | 360 |
| 6 | DOUBLE | 2BAR | 2BAR | 60 | 120 | 180 |
| 7 | 2BAR | 2BAR | 2BAR | 30 | 60 | 90 |
| 8 | DOUBLE | DOUBLE | 1BAR | 60 | 120 | 180 |
| 9 | DOUBLE | 1BAR | 1BAR | 30 | 60 | 90 |
| 10 | 1BAR | 1BAR | 1BAR | 15 | 30 | 45 |
| 11 | DOUBLE | ANY BAR | ANY BAR | 10 | 20 | 30 |
| 12 | ANY BAR | ANY BAR | ANY BAR | 5 | 10 | 15 |
| 13 | DOUBLE | DOUBLE | CHERRY | 80 | 160 | 240 |
| 14 | DOUBLE | CHERRY | CHERRY | 40 | 80 | 120 |
| 15 | CHERRY | CHERRY | CHERRY | 20 | 40 | 60 |
| 16 | DOUBLE | CHERRY | ANY | 10 | 20 | 30 |
| 17 | CHERRY | CHERRY | ANY | 5 | 10 | 15 |
| 18 | CHERRY | ANY | ANY | 2 | 4 | 6 |
| 19 | GIFT BONUS | | | 44.138 | 44.138 | 44.138 |

FIG.18

| CODE NO. | INDEX | NUMBER OF STEPS |
|---|---|---|
| 00 | 1 | 0 |
| 01 | | 18 |
| 02 | | 36 |
| 03 | | 54 |
| 04 | | 72 |
| 05 | | 91 |
| 06 | | 109 |
| 07 | | 127 |
| 08 | | 145 |
| 09 | | 163 |
| 10 | | 182 |
| 11 | 2 | 200 |
| 12 | | 218 |
| 13 | | 236 |
| 14 | | 254 |
| 15 | | 273 |
| 16 | | 291 |
| 17 | | 309 |
| 18 | | 327 |
| 19 | | 345 |
| 20 | | 364 |
| 21 | | 382 |

※ NUMBER OF STEPS WHILE INDEX 1 IS DEFINED AS REFERENCE

200

| | | | | |
|---|---|---|---|---|
| GAME COUNT | 300 | 300 | 600 | 400 |
| ACCUMULATIVE NUMBER OF ENTRIES | 15000 | 15000 | 30000 | 20000 |
| ACCUMULATIVE NUMBER OF PAYOUTS | 13500 | 16500 | 22500 | 10000 |
| PROFITS AND DEFICITS | -1500 | 1500 | -7500 | -10000 |
| RETURN PERCENTAGE (%) | 90 | 110 | 75 | 50 |

GAMING SYSTEM WITH COMMON DISPLAY AND CONTROL METHOD OF GAMING SYSTEM

This application claims priority of U.S. Provisional Application No. 61/038,499 filed on Mar. 21, 2008. The contents of this application are incorporated herein by reference in their entirety.

BACKGROUND OF THE INVENTION

1. Technical Field

The present invention relates to a gaming machine with a common display device and a control method thereof.

2. Description of the Related Art

Conventionally, in gaming facilities in which gaming machines such as slot machines are installed, players can enjoy games by inserting a variety of gaming mediums such as coins and cashes. Each of the gaming machines is designed so as to pay out a payment according to a winning prize (game outcome) that takes place in the progress of a game.

In a casino in which a plurality of slot machines are installed, there is a so called "jackpot" from which, after part of the credit consumed in each of the slot machines has been reserved, if the amount of the reservation reaches a predetermined amount of money, a large amount of payout is made such that a payment is not paid out to any of the slot machines in an ordinary hit (see Published US Patent Application No. 2003/073486, for example). In such slot machines, in the ordinary case, a hit takes place at each of the set probabilities, and players conduct games while anticipating the hit. By means of lottery other than that of the ordinary hit, which is based upon each of the probabilities set in the slot machines, a jackpot hit will take place on any of the slot machines with a predetermined timing.

The conventional gaming machines include those in which, if a gaming medium loss reaches a predetermined amount, a return is given to players who are performing games. The gaming machines having such a return function are characterized in that a countdown effect is rendered by a predetermined period that took until the return is performed. These machines are disclosed in U.S. Pat. Nos. 5,820,459 and 6,695,697, for example.

However, a game effect such as the countdown effect described above is enjoyable to players who well know the contents of the game, and however, those who does not know the contents of the game is not aware of what is going on, and the counted effects are always neither interesting nor attractive to them.

In addition, in a case where a display device is additionally provided to display the advantageous effect as described above, if nothing is displayed in a period in which no advantageous effect is performed, and an image irrelevant to the contents of the game is displayed, it can be said that hardware resources are not effectively utilized.

The present invention has been made in view of the above-mentioned circumstance, and it is an object of the invention to provide a gaming system and a method of controlling the gaming system that is capable of attracting interest or concern of those who does not play a game by explaining the game on the common display, that is capable of alleviating uneasiness for performing the game for a long time, and moreover, that is capable of eliminating a period in which the common display device is not used, and effectively utilize hardware resources.

SUMMARY OF THE INVENTION

A first aspect of the present invention is directed to a gaming system including: a plurality of gaming machines; and a common display device connected to the gaming machines; wherein each of the gaming machines has: a display device, which displays a plurality of symbols; a controller, which executes a process of rearranging symbols arranged on the display device, after a gaming medium is betted, and executing a first game of making a payment according to the rearranged symbols and a process of transferring to a second game which is different from the first game while it is triggered that a predetermined condition is met; a communication interface, which notifies an execution state of the second game to the common display device, and the common display device has: a communication interface, which receives notification from each of the gaming machines; a memory, which stores an effect image relating to the second game and an explanatory image explaining contents of the second game; and a controller, which executes a process of judging whether or not the second game is started in each of the gaming machines, based upon the notification from each of the gaming machines, a process of displaying the explanatory image stored in the memory while the second game is not started in each of the gaming machines, and a process of displaying an effect image stored in the memory in place of the explanatory image, in a case where the second game is started.

According to the aforementioned gaming system, in each of the gaming machine, the game (first game) of making a payment according to the rearranged symbols is performed. The second game is started while it is triggered that the number of times of executing the first game reaches the predetermined value and a randomly determined timing or the like is triggered. The second game includes: a free game executed without a gaming medium being betted; and the common game in which the players at the gaming machines participate simultaneously or the like. The execution state of the second game is notified to the common display device. On the common display device, an explanation of the game contents of the second game is furnished while the second game is not started in each of the gaming machines. Further, if the second game is started, an effect of the second game is rendered on the common display device.

In the aforementioned system, in addition to a base game (first game) of making a payment according to the rearranged symbols, a new game (second game) is implemented if a predetermined condition is met, thus making it possible to prevent players from losing their interest or concern to the play of the games.

In addition, any image is always displayed on the common display device, thus making it possible to eliminate a period in which the common display device is not used and effectively utilize hardware resources.

Further, an explanation of a game is furnished on the common display, thereby making it possible to attract interest or concern to those who are not playing a game. If a new game is introduced, announcement of this game can be performed.

A second aspect of the present invention is directed to the gaming system according to the first aspect, wherein the memory of the common display device stores a plurality of explanatory images each including different animation characters; and the controller of the common display device executes a process of selecting one explanatory image from among the plurality of explanatory images to change an animation character displayed every predetermined time while the second game is not started in each of the gaming machines and a process of displaying the selected explanatory image.

According to the aforementioned gaming system, while the second game is not executed in each of the gaming machines, an explanation of the game contents is furnished while a plurality of animation characters are changed every predetermined time. With the aforementioned constitution, it is possible to attract interest or concern of those who do not play a game.

A third aspect of the present invention is directed to a gaming system, including: a plurality of gaming machines; and a common display device, which is connected to the gaming machines, wherein each of the gaming machines has: a display device, which displays a plurality of symbols; a controller, which executes a process of rearranging symbols arranged on the display device, after a gaming medium is betted, and executing a first game of making a payment according to the rearranged symbols and a process of transferring to a second game which is different from the first game while it is triggered that a predetermined condition is met; and a communication interface, which notifies an execution state of the second game to the common display device, and the common display device has: a communication interface, which receives notification from each of the gaming machines; a memory, which stores an effect image relating to the second game and an explanatory image explaining contents of the second game; and a controller, which executes a process of judging whether or not the second game is started in each of the gaming machines, based upon the notification from each of the gaming machines, a process of selecting one explanatory image from among the plurality of explanatory images to change an animation character displayed every predetermined time while the second game is not started in each of the gaming machines, a process of displaying the selected explanatory image, and a process of displaying the effect image stored in advance in the memory in place of the explanatory image, in a case where the second game is started.

According to the aforementioned gaming system, in each of the gaming machines, the game (first game) of making a payment according to the rearranged symbols is performed. Further, the second game is started while it is triggered that the number of times of executing the first game reaches a predetermined value and while the randomly determined timing or the like is triggered. The second game includes a free game executed without a gaming medium being betted and a common game in which the players of the gaming machines participate simultaneously. The execution state of the second game is notified to the common display device. On the common display device, an explanation of the game contents of the second game is furnished while the second game is not started in each of the gaming machines. Further, if the second game is started, an effect of the second game is rendered on the common display device.

In the aforementioned system, in addition to a base game (first game) of making a payment according to the rearranged symbols, a new game (second game) is implemented if a predetermined condition is met, thus making it possible to prevent players from losing their interest or concern to the play of the games.

In addition, any image is always displayed on the common display device, thus making it possible to eliminate a period in which the common display device is not used and effectively utilize hardware resources.

Further, an explanation of a game is furnished on the common display, thereby making it possible to attract interest or concern to those who are not playing a game. If a new game is introduced, announcement of this game can be performed.

A fourth aspect of the present invention is directed to a gaming system, including: a plurality of gaming machines; and a common display device, which is connected to the gaming machines, wherein each of the gaming machines has: a display device, which displays a plurality of symbols; a controller, which executes a process of rearranging symbols arranged on the display device, after a gaming medium is betted, a process of executing a base game of making a payment according to the rearranged symbols, a process of counting a number of times of executing the base game, a process of causing the display device to display a countdown effect image stored in the memory while the counted number of times of executing the base game reaches a second predetermined value after it has reached a first predetermined value, and a process of transferring to a free game executed without a gaming medium being betted, if the number of execution times has reached the second predetermined value; and a communication interface, which, if the countdown effect image is displayed on the display device, notifies the fact to the common display device, wherein the common display device has: a communication interface, which receives notification from each of the gaming machines; a memory, which stores an explanatory image explaining game contents of the free game; and a controller, which executes a process of judging whether or not display of the countdown effect image is started in each of the gaming machines, based upon notification from each of the gaming machines and a process of displaying the explanatory image stored in the memory unless display of the countdown effect image is started in each of the gaming machines.

According to the aforementioned gaming system, the game (base game) of making a payment according to the rearranged symbols is performed. In addition, the number of times of executing the base game is counted. After the counted number of times has reached the first predetermined value (for example, 990), while the second predetermined value (for example, 1,000) is reached, i.e., while a new game (free game) is started, the countdown effect is rendered. If the countdown effect is rendered, the fact is notified to the common display device. If the number of times of executing the base game has reached the second predetermined value, the game (free game) executed even if gaming mediums such as coins, bills, or electronic security information equivalent thereto are not betted. This free game is a game which the player is allowed to play without need to bet any gaming mediums, and the objective thereof is to return gaming mediums to the players.

On the common display device, the game contents of the free game are explained while the countdown effect is rendered in each of the gaming machines.

Therefore, even if a large number of gaming mediums were consumed by the play of games over a long period of time, the games can be further performed even if no gaming mediums are betted (i.e., with no charge), by performing them until the game count reaches a specific number of times (the second predetermined value). Accordingly, it is possible to prevent players, who consumed a large number of gaming mediums, from raising discomfort or mistrust to the games or from losing interest or concern relevant to the play of games. Further, if the game count is close to a specific number of times, the countdown effect is rendered in each of the gaming machines, thereby making it possible to attract an interest or concern relevant to the play of games On the other hand, while the countdown effect is rendered in each of the gaming machines, an explanation of the game contents of the free game is furnished on the common display device, thus making it possible to attract an interest or concern relevant to those who do not play a game. Further, in the free games the fact that a gaming medium is returned is explained by way of explanatory image, thereby making it possible to attain an advantageous effect of alleviating uneasiness of a player who feels uneasiness in playing games for a long time.

A fifth aspect of the present invention is directed to a gaming system, including: a plurality of gaming machines; and a common display device, which is connected to the gaming machines; wherein each of the gaming machines has: a display device, which displays a plurality of symbols; a controller, which executes a process of rearranging symbols arranged on the display device after a gaming medium is betted, and executing a first game of making a payment according to the rearranged symbols and a process of transferring to a second game which is different from the first game while it is triggered that a predetermined condition is met; a sensing device, which senses presence of a player who is playing a game; and a communication interface, which notifies a sensing result by the sensing device to the common display device, wherein the common display device has: a communication interface, which receives notification from each of the gaming machines; a memory, which stores an explanatory image explaining game contents of the second game; and a controller, which executes a process of judging whether or not there exists a gaming machine which is not played by a player, based upon notification from each of the gaming machines, and a process of displaying the explanatory image stored in the memory, in a case where it is judged that there exists a gaming machine which is not played.

According to the aforementioned gaming system, in each of the gaming machines, the game (first game) of making a payment according to the rearranged symbols is performed. The second game is started while it is triggered that a predetermined condition is met.

In each of the gaming machines, the presence of a player who is playing a game at each of the gaming machine is sensed. Devices which sense the presence of a player include: a device which senses infrared ray emitted from a human body with the use of a pyroelectric infrared-ray sensor; a device which senses a gaming medium which remains in equipment without being betted; and a device or the like, which identifies a player by an ID card for identifying a player.

Information relevant to the presence or absence of a player who is playing a game is notified to the common display device. On the common display device, judgment is made as to whether or not there exists a gaming machine which is not played, and, if there exists a gaming machine which is not played, an explanation of the contents of the second game is furnished.

In the aforementioned system, in addition to the base game (first game) of making a payment according to symbols, a new game (second game) is implemented if a predetermined condition is met, thus making it possible to prevent players from losing an interest or concern relevant to the play of the games.

Further, if there exists a gaming machine which is not played, an explanation of a game is furnished on the common display device, thereby making it possible to attract an interest or concern of those who do not play a game and to promote the play of games. Further, if a new game is introduced, announcement of this game can be performed.

A sixth aspect of the present invention is directed to the gaming system according to the fifth aspect, wherein: each of the gaming machines generates a game history at the controller so as to notify the generated game history to the common display device through the communication interface; and the common display device displays the game history notified from each of the gaming machines, in a case where it is judged by the controller that there does not exist a gaming machine which is not played.

According to the aforementioned gaming machine, if there exists a gaming machine which is not played, a game history of each of the gaming machines, i.e., information such as the number of times of executing games or gained prize money is displayed on the common display device.

A player can compare one's own game history with another player's game history, and thus, for example, if transfer to the second game is performed while the number of times of executing the first game is triggered, it is expected that such player is motivated to transfer to the second game earlier than such another player, and the player's interest and concern can be maintained. Further, the surrounding spectators can be also aware of the fact that the players compete against each other, so that the amusement place and its periphery are in great bustle and become lively.

A seventh aspect of the present invention is directed to the gaming system according to the sixth aspect, wherein: each of the gaming machines notifies an execution state of the second game to the common display device through the communication interface; and the common display device performs at the controller a process of judging whether or not the second game is started at each of the gaming machines and a process of displaying a game history of each of the gaming machines while the second game is not started at each of the gaming machines.

According to the aforementioned gaming machine, the execution state of the second game in each of the gaming machines is notified from each of the gaming machine to the common display. If there does not exist a gaming machine which is not played, while the second game is not started at each of the gaming machine, the game history of each of the gaming machines is displayed in the common display.

Since it is possible for players to compare one player's game history with another player's game history, it is expected that one player is motivated to gain more prize money than another player. As the result thereof, each of the players can be prompted to bet gaming mediums, making it possible to increase profits of a gaming facility in which the aforementioned gaming system is installed.

An eighth aspect of the present invention is directed to a gaming system, including: a plurality of gaming machines; and a common display device, which is connected to the gaming machines; wherein each of the gaming machines has: a display device, which displays a plurality of symbols; a controller, which executes a process of rearranging symbols arranged on the display device, after a gaming medium is betted, and executing a first game of making a payment according to the rearranged symbols, a process of transferring to a second game which is different from the first game while it is triggered that a predetermined condition is met, and a process of generating a game history; a sensing device, which senses presence of a player who is performing a game; and a communication interface, which notifies an execution state of the second game, the game history generated by the controller, and a sensing result by the sensing device to the common display device, and the common display device has: a communication interface, which receives notification from each of the gaming machines; a memory, which stores an explanatory image explaining game contents of the second game; and a controller, which executes a process of judging whether or not a gaming machine exists which is not played by a player, based upon notification from each of the gaming machines and whether or not the second game is started, a process of displaying the explanatory image stored in the memory, in a case where it is judged that a gaming machine exists which is not played, and a process of displaying the game history notified from each of the gaming machines, in a case where it is judged that there does not exist a gaming machine which is not played.

According to the aforementioned gaming system, in each of the gaming machines, the game (first game) of making a payment according to the rearranged symbols is performed. Further, in each of the gaming machine, the presence of a player who is performing a game is sensed by means of the sensing device. The devices that sense the presence of a player include: a device, which senses the infrared-rays emitted from a human body with the use of the pyroelectric infrared sensor; a device, which senses gaming mediums remaining in equipment without being betted; and a device or the like, which identifies a player by an ID card for identifying the player.

Information relevant to the presence or absence of a player who is performing a game is notified to the common display device. On the common display device, judgment is made as to whether or not a gaming machine exists which is not played, and if such gaming machine exists, an explanation of the contents of the second game is furnished. If it does not, while the second game is not started at each of the gaming machines, the game history of each of the gaming machines, i.e., information such as the number of times of executing games or gained prize money is displayed on the common display device.

In the aforementioned system, in addition to a base game (first game) of making a payment according to the rearranged symbols, a new game (second game) is implemented if a predetermined condition is met, thus making it possible to prevent players from losing interest or concern relevant to the play of games. If a gaming machine exists which is not played, an explanation of games is furnished on the common display device, thereby making it possible to attract interest or concern of those who are not performing games and promote the play of games. If a new game is introduced, announcement of this game can be performed.

Since it is possible for players to compare one player's game history with another player's game history, it is expected that one player is motivated to gain more prize money than another player if transfer to the second game is constituted while the number of times of executing the first game is triggered, and the players' interest or concern can be maintained. Further, the surrounding spectators can be also aware of the fact that the players compete against each other, so that the amusement place and its periphery are in great bustle and become lively.

A ninth aspect of the present invention is directed to a gaming system, including: a plurality of gaming machines; and a common display device, which is connected to the gaming machines; a plurality of gaming machines; and a common display device, which is connected to the gaming machines; wherein each of the gaming machines has: a controller, which executes a process of rearranging symbols arranged on the display device, after a gaming medium is betted, and performing a base game of making a payment according to the rearranged symbols, a process of counting a number of times of executing the base game, a process of causing the display device to display a countdown effect image stored in advance in the memory while the counted number of times of executing the base game reaches a second predetermined value after it has reached a first predetermined value, and a process of transferring to a free game executed without a gaming medium being betted, in a case where the number of times of executing the base game reaches the second predetermined value; a sensing device, which senses presence of a player who is playing a game; and a communication interface, which notifies a sensing result by the sensing device to the common display device, and the common display device has: a communication interface, which receives notification from each of the gaming machines; a memory, which stores an explanatory image explaining game contents of the free game; and a controller, which executes a process of judging whether or not there exists a gaming machine which is not played by a player, based upon notification from each of the gaming machines, and a process of displaying the explanatory image stored in the memory, in a case where it is judged that there exists a gaming machine which is not played.

According to the aforementioned gaming system, in each of the gaming machines, the game (base game) of making a payment according to the rearranged symbols is performed. Further, if the number of times of executing the base game reaches a specific number of times (second predetermined value), a game (free game) executed even if gaming mediums such as coins, bills, or electronic security information equivalent thereto are not betted.

Further, at each of the gaming machines, the presence of a player who is performing a game is sensed by means of the sensing device, and the sensing result is notified to the common display device. On the common display device, judgment is made as to whether or not a gaming machine exists which is not played, and if such gaming machine exists, an explanation of the contents of the free game is furnished.

In the aforementioned system, if a gaming machine exists which is not played, an explanation of the game contents of the free game is furnished on the common display device, thus making it possible to attract interest or concern of those who are not performing games. Further, the fact that return of gaming mediums is performed in the free game is explained by way of explanatory image, thereby making it possible to attain advantageous effect of alleviating uneasiness of players in playing games for a long time.

A control method according to a tenth aspect of the present invention is directed to a method of displaying contents of games executed in a plurality of gaming machines on a common display device connected to the gaming machines, said method executing the steps of: at each of the gaming machines, rearranging symbols arranged on a display device, after a gaming medium is betted, and executing a first game of making a payment according to the rearranged symbols; transferring to a second game which is different from the first game while it is triggered that a predetermined condition is met; and, on each of the gaming machines; and notifying an execution state of the second game to the common display device, and on the common display device, judging whether or not the second game is started at each of the gaming machines, based upon the notification from each of the gaming machines; displaying an explanatory image explaining game contents of the second game stored in a memory while the second game is not started at each of the gaming machines; and displaying an effect image relevant to the second game stored in the memory in place of the explanatory image, in a case where the second game is started in each of the gaming machine.

According to the aforementioned control method, in each of the gaming machines, the game (first game) of making a payment according to the rearranged symbols is performed. Further, the second game is started while it is triggered that the number of times of executing the first game reaches a predetermined value and while a randomly determined timing or the like is triggered. The second game round include: a free game executed without gaming mediums being betted;

and a common game or the like in which players at the gaming machines participate simultaneously.

The execution state of the second game is notified to the common display device. On the common display device, an explanation of the game contents of the second game is furnished while it is started at each of the gaming machines. If the second game is started, an effect of the second game is rendered on the common display.

In the aforementioned control method, in addition to the base game (first game) of making a payment according to the rearranged symbols, a new game (second game) is implemented if a predetermined condition is met, thus making it possible to prevent players from losing interest or concern relevant to the play of games. In addition, any image is always displayed on the common display device, thus making it possible to eliminate a period in which the common display device is not used and effectively utilize hardware resources. Further, an explanation of a game is furnished on the common display device, thereby making it possible to attract interest or concern of those who are not performing a game. If a new game is introduced, announcement of this game can be performed.

A control method according to an eleventh aspect of the present invention is directed to a method of displaying contents of games executed in a plurality of gaming machines on a common display device connected to the gaming machines, the method executing the steps of: at each of the gaming machines, rearranging symbols arranged on a display device, after a gaming medium is betted, and executing a first game of making a payment according to the rearranged symbols; and transferring to a second game which is different from the first game while it is triggered that a predetermined condition is met, sensing presence of a player who is performing a game; and notifying a sensing result by the step on the common display device to the common display device, and on the common display device, judging whether or not a gaming machine exists which is not played by a player, based upon notification from each of the gaming machines; and displaying an explanatory image explaining game contents of the second game stored in a memory, in a case where it is judged that a gaming machine exists which is not played.

According to the aforementioned control method, in each of the gaming machines, the game (first game) of making a payment according to the rearranged symbols is performed. Further, the second game is started while it is triggered that a predetermined condition is met. In each of the gaming machines, the presence of a player who is performing a game is sensed by means of the sensing device. The devices that sense the presence of a player include: a device, which senses the infrared-rays emitted from a human body with the use of the pyroelectric infrared sensor; a device, which senses gaming mediums remaining in equipment without being betted; and a device or the like, which identifies a player by an ID card for identifying the player.

Information relevant to the presence or absence of a player who is performing a game is notified to the common display device. On the common display device, judgment is made as to whether or not a gaming machine exists which is not played, and if such gaming machine exists, an explanation of the contents of the second game is furnished.

In the aforementioned control method, in addition to the base game (first game) of making a payment according to the rearranged symbols, a new game (second game) is implemented if a predetermined condition is met, thus making it possible to prevent players from losing interest or concern relevant to the play of games. In addition, if a gaming machine exists which is not played, an explanation of a game is furnished on the common display device, thereby making it possible to attract interest or concern of those who are not performing games and promote the play of a game. Further, if a new game is introduced, announcement of this game can be performed.

BRIEF DESCRIPTION OF THE DRAWINGS

FIG. 4 is a view for explaining a payout table in the embodiment;

FIG. 18 is a schematic view showing a correlation table between the number of steps and code Nos.

DESCRIPTION OF THE PREFERRED EMBODIMENTS

Figure 1:
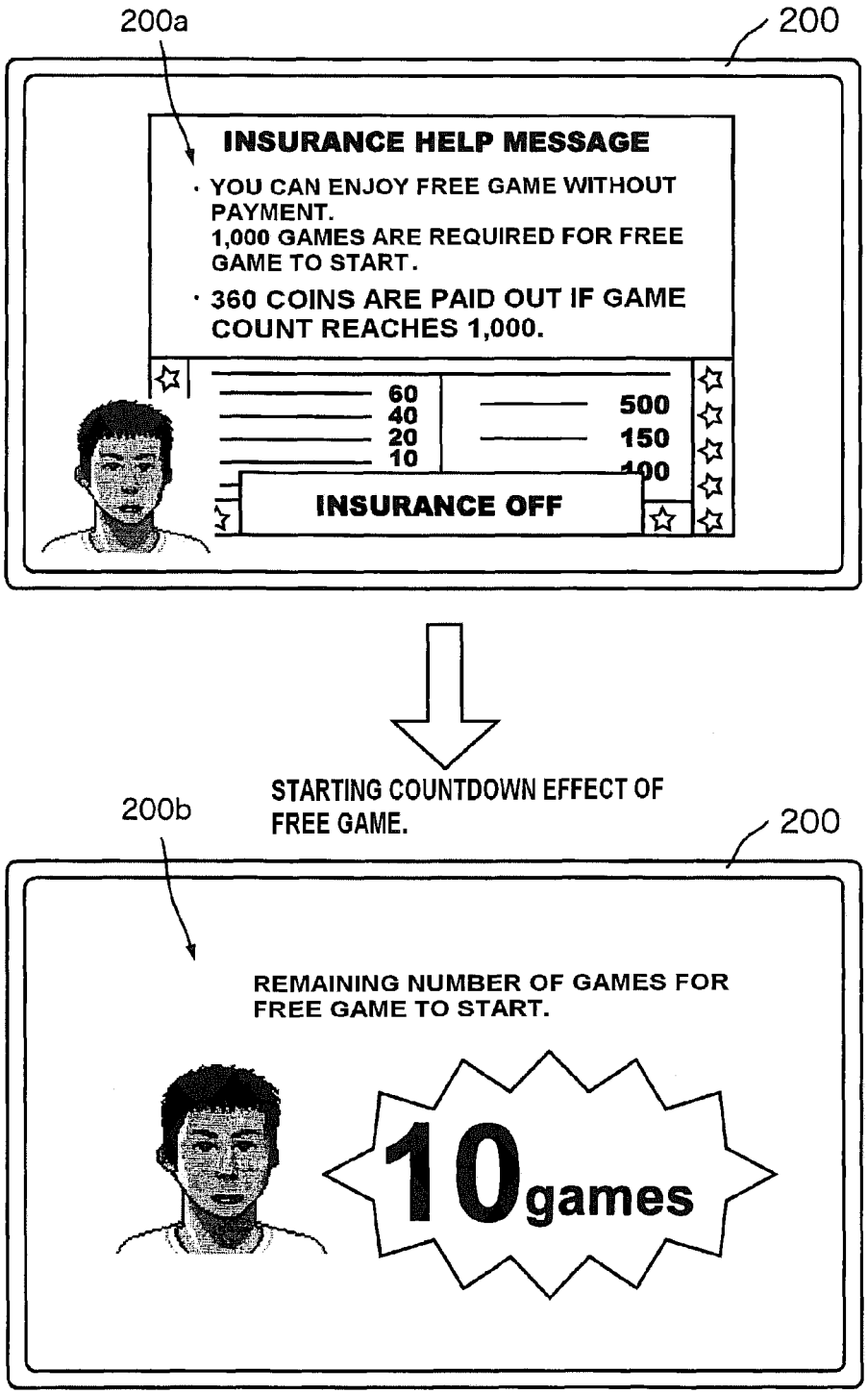
FIG. 1 is a schematic view showing an exemplary image displayed on a common display device according to the present embodiment.

Hereinafter, embodiments of the present invention will be described in detail with referring to the drawings.

First Embodiment

FIG. 1 is a schematic view showing an exemplary image displayed on the common display device according to the present embodiment. The gaming system 1 according to the present embodiment is provided with four gaming machines 10A to 10D and a common display device 200 connected thereto (see FIG. 2). Hereinafter, the gaming machines 10A to 10D are simply referred to as gaming machines 10 as long as there is no need to discriminate them from one another.

In the present embodiment, the gaming machines 10 are equivalent to slot machines. In the invention, however, the gaming machines may be so called single gaming machines such as video slot machines or video card games, for example, without being limitative to the slot machines. Alternatively, they are so called mass-entertainment-type gaming machines (multi-terminal gaming machines) which perform games such as a horserace game, a bingo game, and lottery, for example, requiring a predetermined time until the game outcomes are displayed.

In the gaming machine 10, coins, bills, or electronic valuable information are employed as gaming mediums. In the present invention, however, medals, tokens, electronic money, or tickets, for example, may be employed as gaming mediums without being limitative thereto in particular. As the abovementioned tickets, for example, bar code-attached tickets, as described later, may be employed without being limitative thereto in particular.

The common display device 200 serves as a display device for presenting information to be shared among the players who are playing games at the gaming machines 10 or displaying the contents of games, which are executed at the gaming machines, or the effect images. In the present embodiment, it is assumed that four gaming machines 10 are connected to one common display device 200. The number of gaming machines 10 connected to one common display device 200 is not limitative to four, and a plurality of gaming machines 10 may be connected thereto.

To the gaming machines 10, specific ID numbers (i.e., identification information for identifying the gaming machines 10) thereof are assigned, and the common display device 200 discriminates sources of data which is sent from each of the gaming machines 10. Data which each of the gaming machines 10 transmits to the common display device can include information which is indicative of a game history such as the number of times of executing base games, accumulative number of coin entries, and accumulative payout number. Even in the case of transmitting data from the common display device 200 to the gaming machines 10, a transmission destination is specified using ID numbers. The identification information of the gaming machines may include characters, signs, numerals, and combinations thereof, for example, without being limitative thereto.

In the gaming machines 10, a game is performed in which, gaming mediums of which the number is not greater than a maximum predetermined BET number are betted, and thereafter, a plurality of symbols are variably displayed on reels (see FIG. 4) serving as symbol display devices. Further, the variably displayed symbols are displayed in a stopped state, and the amount of payment is determined according to the symbols displayed in a stopped state or a combination of the displayed symbols (hereinafter, referred to as a base game which is generally performed in a slot machine or the like).

Moreover, an insurance-off mode is transferred to an insurance-on mode on condition that a predetermined number (1, in the embodiment) of gaming mediums has been entered. If the number of times of executing all of the base games performed after transfer to the insurance-on mode (hereinafter, referred to as total game count C) reaches a predetermined number (second predetermined value Th2, for example, 1,000 times), a predetermined number of gaming media (360 in the embodiment) is paid, and a free game is performed.

The free game is performed even if no gaming mediums are betted. In this game, a plurality of symbols is variably displayed on reels 14, and thereafter, the variably displayed symbols are displayed in a stopped state. Further, the amount of payment is determined according to the symbols displayed in a stopped state or a combination of the displayed symbols. In other words, the free games, the contents of which are identical to those of base games, are performed even if no gaming medium is betted. The free games may be performed by a predetermined number of times (for example, 1000 times), or alternatively, may be varied according to the game history of the base game.

The gaming system 1 according to the embodiment renders countdown effects on both of the gaming machines 10 and the common display device 200 until the free game is started, in order to enhance anticipation or excitement of the players relative to the free games. This countdown effect is rendered by displaying the countdown effect images on the display device (upper image display panel 33) of the gaming machine 10 in which the number of times of executing the game reaches the first predetermined value Th1 if the number of times of executing the base games reaches a specific number of times (first predetermined value Th1, for example 990 times), and the common display device 200. If the countdown effect is not rendered in any of the gaming machines 10, the common display device 200 displays an explanatory image showing the game contents of a free game (second game of the present invention).

In the example shown in FIG. 1, there is shown how the common display device 200 displays an explanatory image 200*a* while the countdown effect of the free game is started. This explanatory image 200*a* is an image for explaining the game contents of the free game, and an explanation is furnished to an extent such that the free game can be executed with no payment; 1,000 base games are required until the free game is started; and 360 coins are paid at the time of start of the free game.

If the countdown effect of the free game is started in any of the four gaming machines 10A to 10D, the common display device 200 displays a countdown effect image 200*b* as shown in FIG. 1. Although not shown, the display device of the gaming machine 10 in which the countdown effect is started is also constituted so as to display like countdown effect image 200*b*.

Figure 2:
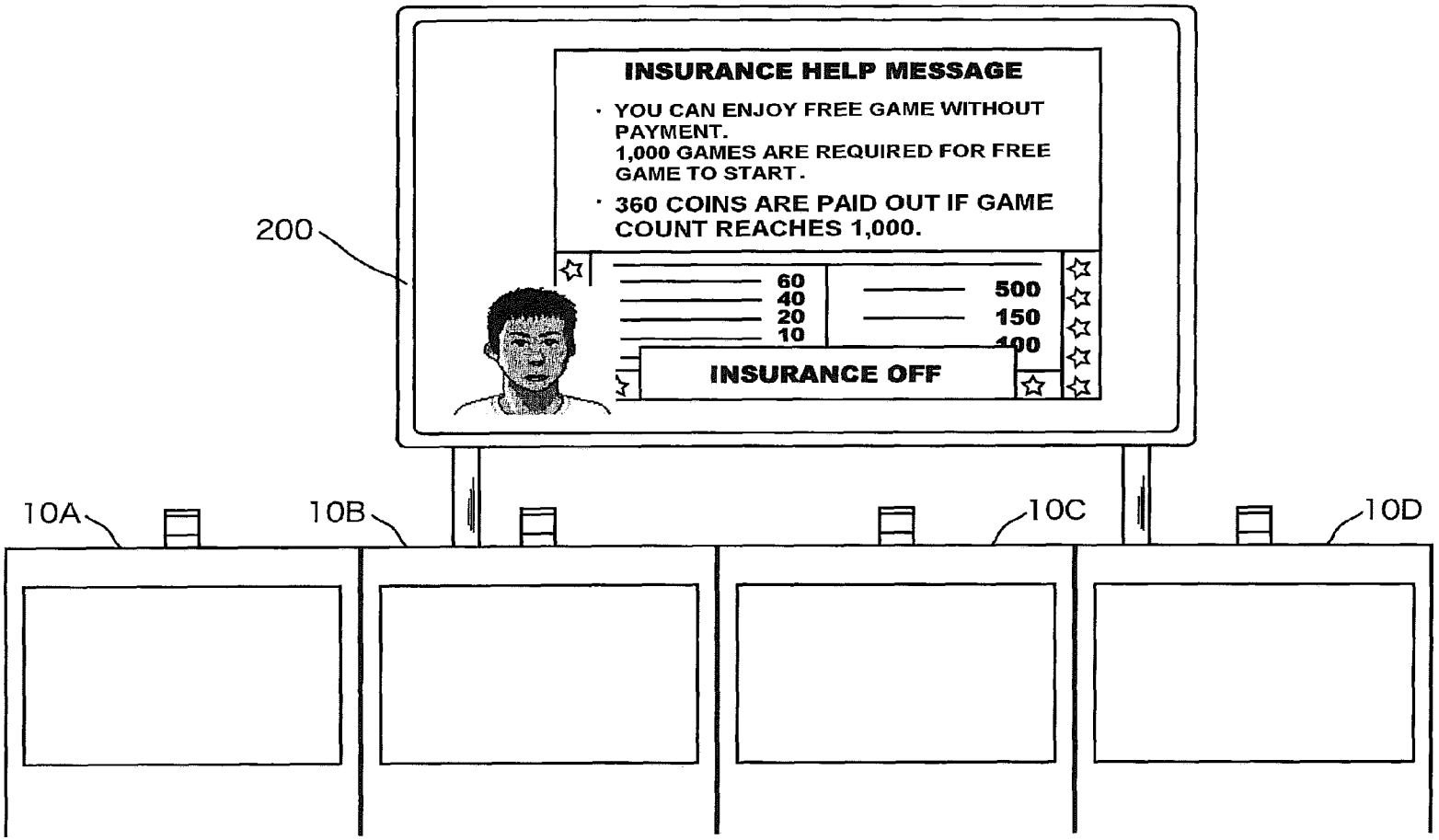
FIG. 2 is a schematic view showing a configuration of a gaming system according to the present embodiment.

FIG. 2 is a schematic view showing a configuration of the gaming system 1 according to the present embodiment. A gaming system 1 according to the embodiment is provided with: four gaming machines 10A to 10D; and a common display device 200, which is connected thereto. These four gaming machines 10A to 10D are integrally concatenated with each other, and the common display device 200 is supported by a column provided at the rear side of the gaming machines 10A to 10D. Such gaming system 1, which is capable of performing a variety of games, may be constructed in one gaming facility such as bar parlor or casino, or alternatively, may be constructed among a plurality of gaming facilities. The gaming system 1 may be constructed in one gaming facility on a floor-by-floor basis or on a section-by-section basis in the gaming facility.

Figure 3:
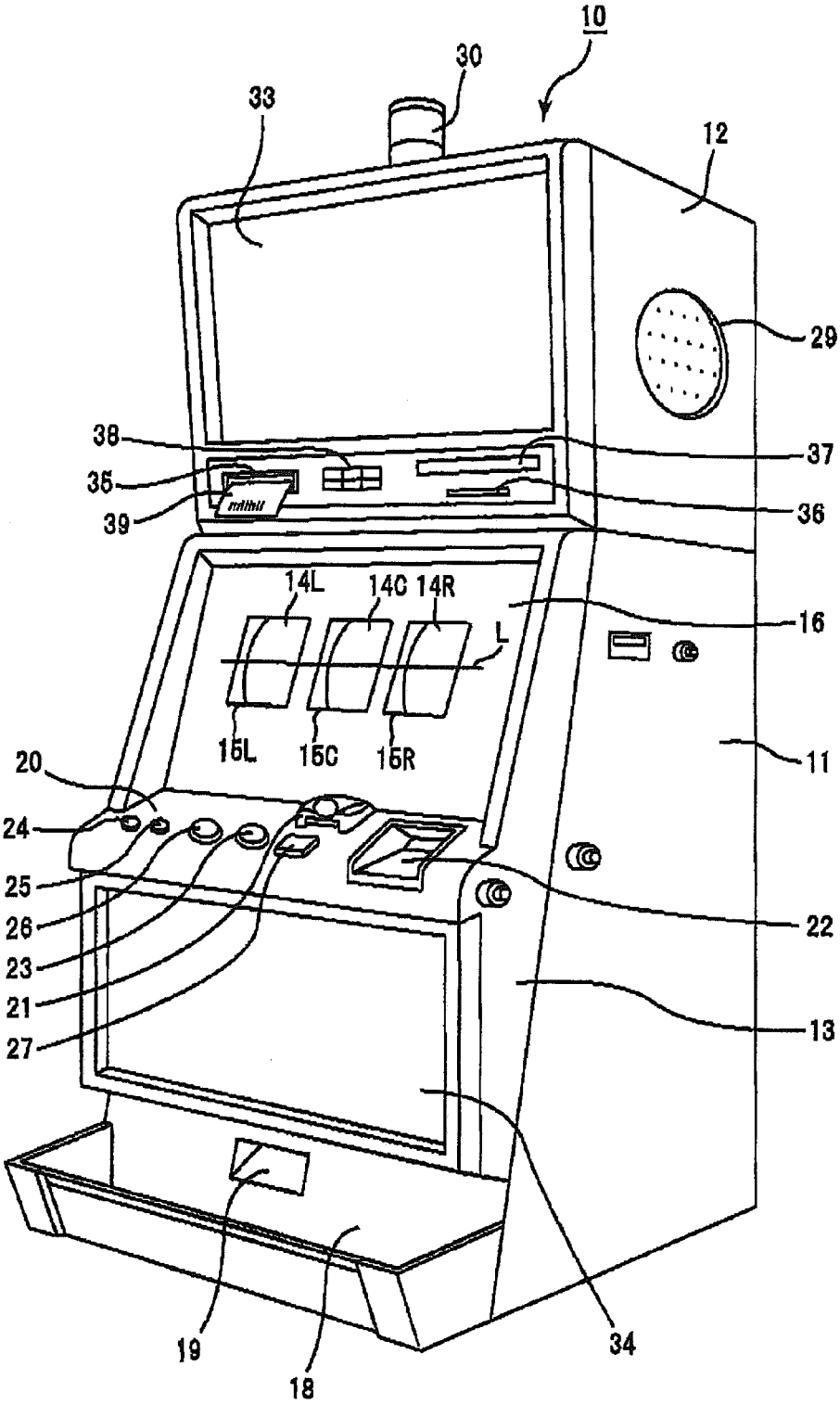
FIG. 3 is a perspective view schematically showing a gaming machine.

FIG. 3 is a perspective view schematically showing the gaming machine 10. The slot machine 10 is provided with: a cabinet 11; a top box 12 installed at the upper side of the cabinet 11; and a main door 13 provided at the front face of the cabinet 11. Three reels 14 (14L, 14C, 14R) are rotatably provided inside of the cabinet 11. A symbol array consisting of 22 patterns (hereinafter, referred to as symbols) is drawn on the outer periphery of each of the reels 14.

A lower image display pane 16 is provided in front of each of the reels 14 at a main door 13. The lower image display panel 16 is provided with a transparent liquid crystal display panel on which a variety of images or effect images, etc., pertinent to games are displayed during the play of the games. A credit amount display section 31 and a payout number display section 32 are set on the lower image display panel 16. The credit amount display section 31 displays the number of credited coins by way of image. The payout number display section 32 displays, by way of image, the number of coins to be paid out if a predetermined combination of symbols is displayed in a stopped state on a payline L.

On the lower image display panel 16, three display windows 15 (15L, 15C, 15R), which are capable of visually recognizing a rear face of the display panel, are formed, and the symbols drawn on the outer periphery of the reels 14 via the display windows 15 are displayed on a three-by-three symbols basis. On the lower image display panel 16, one payline horizontally crossing the three display windows 15 is formed. The payline L defines a combination of symbols. If a predetermined combination of symbols is displayed in a stopped state on the payline L, coins are paid out, the number of which corresponds to the predetermined combination and the number of inserted coins (BET number).

In the present invention, for example, where a plurality of paylines L horizontally or obliquely crossing the three display windows 15, for example, is formed, the paylines L are activated, the number of which corresponds to that of inserted coins, and then, a predetermined combination of symbols are displayed in a stopped state, coins of which the number corresponds to the predetermined combination may be paid out.

Further, on a front face of the lower image display panel 16, a touch panel 69 is provided, although not shown, so that a player can enter various instructions (pertinent to an insurance-on mode, for example) by operating the touch panel 69.

Downwardly of the lower image display panel 16, a control panel 20 consisting of a plurality of buttons 23 to 27 for entering instructions pertinent to the progress of a game by a player; a coin insertion slot 21 for accepting coins in the cabinet 11; and a bill validator 22 are provided.

On the control panel 20, a SPIN button 23, a CHANGE button 24, a CASHOUT button 25, a 1-BET button 26, and a MAX-BET button 27 are provided. The spin button 23 is for inputting an instruction for starting rotation of the reels 14. The change button 24 is intended for use in asking an attendant of the gaming facility for change. The CASHOUT button 25 is intended to enter an instruction for paying out credited coins to the coin tray 18.

The 1-BET button 26 is intended to enter an instruction for betting one coin on a game from among the credited coins. The MAX-BET button 27 is intended to enter an instruction for betting the maximum number of credited coins (50 coins in the embodiment) that can be betted on one game.

In the present invention, insertion of gaming mediums denotes that gaming mediums are consumed. The gaming mediums are consumed where they are betted on a game and where they are consumed to migrate to an insurance-on mode described later. For example, if the coins inserted into the coin insertion slot 21 are directly betted on a game, the coin insertion into the coin insertion slot 21 is equivalent to gaming medium insertion. As in the present invention, however, if coins are temporarily credited after being inserted into the coin insertion slot 21 and if the credited coins are betted by operating the 1-BET button 26 or the MAX-BET button 27, such betting is equivalent to gaming medium insertion.

The bill validator 22 validates whether or not a bill is legitimate and accepts a legitimate bill in the cabinet 11. The bill validator 22 may be configured so that a barcode-attached ticket 39 described later is readable thereby. On the lower front face of the main door 13, i.e., downwardly of the control panel 20, a belly glass 34, on which characters or the like of the gaming machine 10 are drawn, is provided.

On the front face of the top box 12, an upper image display panel 33 is provided. The upper image display panel 33 is provided with a liquid crystal panel, and, for example, images are displayed which is indicative of an introduction to effect images or the contents of games and an explanation of the rules of the games.

On the top box 12, a speaker 29 is provided. At the lower side of the upper image display panel 33, a ticket printer 35, a card reader 36, a data display 37, and a keypad 38 are provided. The ticket printer 35 prints, on tickets, bar codes containing coded data such as credit amount, date and time, or ID numbers of the gaming machine, and the bar code-attached tickets 39 are output. Players can play games at the gaming machine by causing another gaming machine to read the bar code-attached ticket 39 or can exchange the bar code-attached ticket 39 with a bill or the like at a predetermined site of the gaming facility (for example, at cashier in casino).

The card reader 36 is intended to read and write data from/into a smart card. The smart card is owned by a player, and stores data for identifying a player or data pertinent to a history of games performed by players, for example. The smart card may store data equivalent to coins, bills, or credits. In place of the smart card, further, a magnetic stripe card may be employed. The data display 37 is made up of a fluorescent display or the like, and stores data read by the card reader 36 or data input by a player via the keypad 38, for example. The keypad 38 is intended for entering the instructions or data pertinent to the issuance of tickets.

FIG. 4 is a view for explaining a payout table in the embodiment. "The symbols "DOUBLE", "3BAR", "2BAR", "1BAR", and "CHERRY" in the payout table indicate types of symbols drawn on each of the reels 14. Apart from the abovementioned symbols, a bonus trigger, which is a symbol corresponding to "GIFT BONUS"", and other symbols are also drawn on each of the reels 14. "ANY BAR" contained in the payout table indicates "3BAR", "2BAR", or "1BAR", and "ANY" denotes any symbol.

Combinations of the symbols shown in the payout table denote winning combinations, and the payout number of coins according to a BET number is set for each of the combinations. If a combination of the symbols displayed in a stopped state on each of the reels 14 is that of the bonus triggers of "GIFT BONUS", a predetermined number of coins are paid out as a jackpot. The numerical values corresponding to "GIFT BONUS" described on the payout table denote expectation values of the coin payout numbers, and are uniform irrespective of the BET numbers. If the number of bets is 1BET, therefore, settings are provided such that a probability of "GIFT BONUS" is low and a large number of coins are paid out. This probability is set according to symbol-weighted data.

Four different types of jackpots "GRAND", "MAJOR", "MINOR", and "MINI" are provided in sequential order from the largest payout number of coins. The lower probabilities of occurrence of these jackpots are set, as the larger the payout number of coins is, and which one of the jackpots is established is randomly determined using random number values. The expectation values of the coin payout numbers in the jackpots are uniform.

After the 1-BET button 26 or the MAX-BET button 27 has been depressed, when a SPIN button 23 is depressed to start a game, the columns of the symbols drawn on each of the reels 14 are displayed in a scrolled-down manner, together with rotation of each of the reels 14. After elapse of a predetermined time, these columns of the symbols are displayed in a stopped state on the display window 15, together with rotation stop of each of the reels 14. Further, if a variety of winning combinations is predetermined based upon combinations of the symbols, and then, a combination of the symbols corresponding to one of these winning combinations is stopped on a payline L, the payout number of coins corresponding to the winning combination is added to the player-owned credit. When a combination of "GIFT BONUS" bonus triggers is realized, a predetermined payout number is added to the player-owned credit.

The present embodiment describes a case in which a jackpot-based coin payout is made when a combination of bonus triggers is realized. In the present invention, however, a game-playing state, which is established when the combination of the bonus triggers is realized, is not limitative in particular, and games such as a second game and a mystery bonus game can be performed, for example. When the bonus trigger combination is realized, a bar code-attached ticket 39 on which the predetermined information was printed may be issued.

In the payout table, combinations of the symbols indicated by italics are those in which 180 or more coins are paid out when they are realized in a game performed by MAX-BET. In the game performed by MAX-BET in an insurance-on mode, if any one of these symbol combinations is realized, the insurance-on mode migrates to the insurance-off mode.

Figure 5:
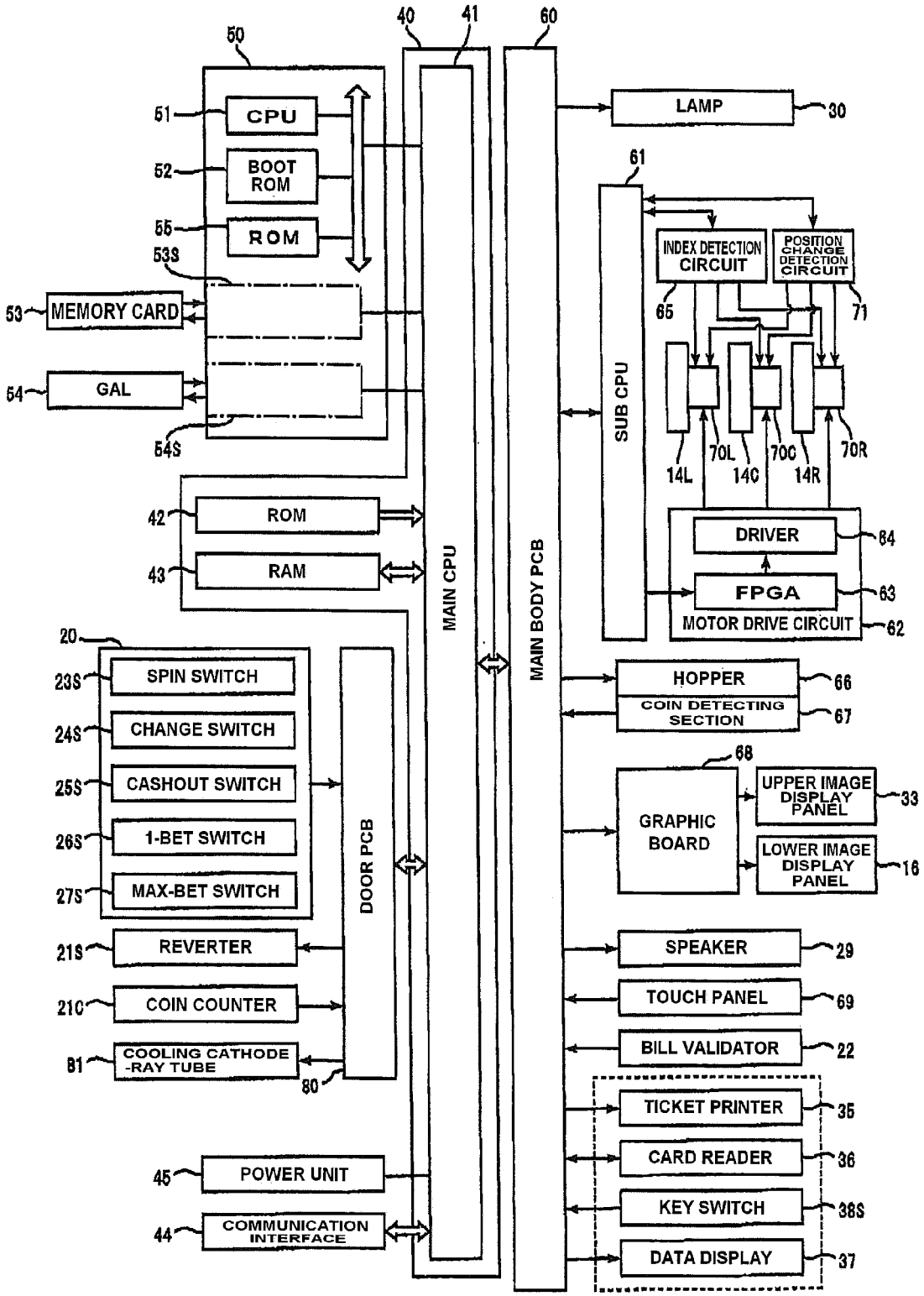
FIG. 5 is a block diagram depicting an internal configuration of the gaming machine.

FIG. 5 is a block diagram depicting an internal configuration of the gaming machine 10. A gaming board 50 is provided with: a CPU (Central Processing Unit) 51, a ROM55, and a boot ROM52, which were interconnected via an internal bus; a card slot 53S compatible with a memory card 53; and an IC socket 54S compatible with a GAL (Generic Array Logic) 54.

The memory card 53 is made up of a nonvolatile memory such as Compact Flash (registered trademark), and stores game programs and game system programs. The game programs include a stopped-symbol determination program. The stopped-symbol determination program is intended to determine symbols of each of the reels 14, which are displayed in a stopped state on the payline L (code No. corresponding to symbols). The above stopped-symbol determination program includes symbol-weighted data corresponding to each of a plurality of payout rates (80%, 84%, 88%, for example). The symbol-weighted data is indicative of a correspondence between code Nos. of symbols (see FIG. 4) and one or a plurality of random number values belonging to a predetermined numeric range (0 to 256). The payout rates are determined based upon the payout rate setting data that is output from the GAL 54, and lottery is performed based upon the symbol-weighted data corresponding to the payout rates.

In addition, a card slot 53S is constituted to enable removable insertion of the memory card 53, and the card slot is connected to a motherboard 40 by means of an IDE bus. Therefore, the memory card 53 is removed from the card slot 53S, other game programs and game system programs are written into the memory card 53, and thereafter, the memory card 53 is inserted into the card slot 53S, thereby making it possible to vary the kinds or contents of the games performed at the gaming machine 10. Further, the memory card 53 storing one group of game programs and game system programs is replaced with that storing another group of game programs and game system programs, thereby making it possible to vary the kinds or contents of the games performed at the gaming machine 10. The game programs include those which are relevant to the operating procedures for performing games. Further, they also include image data or sound data output during the play of a game and image data or sound data for notifying a transfer to the insurance-on mode.

The GAL 54 is a kind of PLD having an OR-fixed arrayed structure. The GAL 54 is provided with pluralities of IN ports and OUT ports. If predetermined items of data are input to the IN port, the corresponding data is output from the OUT port. The data output from the OUT port is equivalent to the above-described payout rate setting data. The IC socket 54S is constituted so as to allow the GAL 54 to be removably mounted, and is connected to the motherboard 40 by means of a PCI bus. Therefore, the GAL 54 is removed from the IC socket 54S, the programs stored in the GAL54 are rewritten, and the GAL 54 is mounted to the IC socket 54S, thereby making it possible to vary the payout rate setting data output from the GAL 54. Further, the GAL 54 is replaced with the replacement GAL 54, thereby making it possible to vary the payout rate setting data.

The CPU51, the ROM55, and the boot ROM52 interconnected via the internal bus are connected to the motherboard 40 via a PCI bus. The PCI bus not only performs signal transmission between the motherboard 40 and the gaming board 50, but also supplies power from the motherboard 40 to the gaming board 50. The PCI bus serves to transmit signals between the mother board 40 and the gaming board 50 and supply power from the mother board 40 to the gaming board 50. The ROM 55 stores country ID information and authentication programs. The boot ROM 52 stores a preliminary authentication program and a program (boot code) or the like for the CPU 51 to boot the preliminary authentication program.

The authentication program is a program (falsification check program) for authenticating game programs and game system programs. The authentication program is described along verification and certification of the fact that the game programs and game system programs targeted for authentication capturing processing are not falsified, i.e., along the procedures for authenticating the game programs and game system programs (authentication procedures). The preliminary authentication program is intended to authenticate the authentication program described above. The preliminary authentication program is described along certification of the fact that the authentication program targeted for authentication processing is not falsified, i.e., along the procedures for authenticating the authentication program (authentication procedures).

The motherboard 40 is constituted using a commercially available motherboard (printed wiring board mounting basic parts of a personal computer), and is provided with: a main CPU 41; a ROM (Read Only Memory) 42; a RAM (Random Access Memory) 43; and a communication interface 44. The main CPU 41 serves as a processor of the present invention.

The ROM 42 stores the programs and permanent data of a BIOS (Basic Input/Output System) or the like, which is made up of memory devices such as a flash memory and executed by the main CPU 41. When the BIOS is executed by the main CPU 41, processing of initializing predetermined peripheral devices is carried out and processing of capturing game programs and game system programs stored in the memory card 53 through the gaming board 50 is started. In the present invention, the contents of the ROM 42 may be rewritable or not.

The RAM 43 stores data and programs used when the main CPU 41 is activated. Further, the RAM 43 can store authentication programs, game programs, and game system programs read via the gaming board 50.

In the RAM 43, an area for storing data indicative of total game count C and an area for storing data indicative of the remaining free game count are provided. The remaining free game count is indicative of the remaining counted number of unit free game repeated as a free game.

In the RAM 43, an area for storing an insurance-on mode flag is provided. The insurance-on mode flag is indicative of whether an insurance-on mode or an insurance-off mode is established. The insurance-on mode flag storing area consists of a predetermined bit number of storing areas, for example, and the insurance-on mode flag is set to "ON" or "OFF", according to the contents of storage in the storing area. The insurance-on mode flag "ON" indicates an insurance-on mode and the insurance-off mode flag "OFF" indicates an insurance-off mode. Further, the RAM 43 stores the data of credit amounts and coin insertion numbers or payout numbers in one game.

The communication interface 44 is intended to perform communication with a common display device 200 via a communication line 101. The main CPU 41 transmits to the common display device 200, together with the gaming machine identification number of the gaming machine 10, information such as total game count C, coin insertion count in a game, and payout number, every time one game is performed. The common display device 200 stores a total game count C, a game count, an accumulative coin insertion number, and an accumulative payout number, in association with each of the gaming machine ID numbers.

Both a body PCB (Printed Circuit Board) 60 and a door PCB80, which will be described later, are connected to the motherboard 40 by the USB. Further, a power unit 45 is connected to the motherboard 40. When power is supplied from the power unit 45 to the motherboard 40, the main CPU 41 of the motherboard 40 is activated. Further, power is supplied to the gaming board 50 via the PCI bus, and then, the CPU 51 is activated.

To the main body 60 and the door PCB 80, equipment or devices, for generating an input signal input to the main CPU 41, and those of which operation is controlled by means of a control signal output from the main CPU 41, are connected. The main CPU 41 executes the game programs and game system programs stored in the RAM 43, based upon an input signal which were input to the main CPU 41, thereby performing predetermined computation to store a result thereof to the RAM 43 or transmit a control signal to equipment or devices in a control process relevant to equipment or devices.

To the main body PCB 60, a lamp 30, a sub CPU 61, a hopper 66, a coin detecting section 67, a graphic board 68, a speaker 29, a touch panel 69, a bill validator 22, a ticket printer 35, a speaker 29, a touch panel 69, a bill validator 22, a ticket printer 35, a card reader 36, a key switch 38S, and a data display 37 are connected. The lamp 30 lights in a predetermined pattern, based upon a control signal output from the main CPU 41.

A sub CPU 61 controls rotation and stoppage of reels 14 (14L, 14C, 14R). To the sub CPU 61, a motor driving circuit 62, which is provided with an FPGA (Field Programmable Gate Array) 63 and a driver 64, is connected. The FPGA 63 is an electronic circuit such as a programmable LSI, and functions as a control circuit of stepping motors 70. The driver 64 functions as an amplification circuit of pulses input to the stepping motors 70. The stepping motors 70 (70L, 70C, 70R) for rotating each of the reels 14 are connected to the motor drive circuit 62. Each of the stepping motors 70 is a 1-2 phase-excitation type stepping motor.

In the present invention, the excitation system of the stepping motor is not limitative in particular, and, for example, it is also possible to employ an excitation system such as a 2-phase excitation system or a 1-phase excitation system. Further, a DC motor may be employed in place of the stepping motor. If the DC motor is employed, a deviation counter, a D/A converter, and a servo amplifier are sequentially connected to a sub CPU 61, and the DC motor is connected to the servo amplifier. Furthermore, the rotational position of the DC motor is detected by means of a rotary encoder, and the current rotational position of the DC motor is supplied as data from the rotary encoder to the deviation counter.

An index detection circuit 65 and a position detection change circuit 71 are connected to the sub-CPU 61. The index detection circuit 65 is intended to detect the position (index which will be described later) of the reels 14 in rotation, and further, is capable of detecting pulling out of synchronization of the reels 14. Control of rotation and stoppage of the reels 14 will be described later in detail with referring to the drawings.

The position change detection circuit 71 detects a change of a stop position of the reels 14 after rotation of the reels 14 has stopped. For example, the position change detection circuit 71 detects a change of the stop position of the reels 14 according to a case, etc., in which a player forcibly changes the stop position so as to realize a winning combination of symbols, in spite of the fact that none of the winning symbol combinations is actually realized. The position change detection circuit 71 is constituted so that the change of the stop position of the reels 14 can be detected by detecting a fin (not shown) mounted to the inside of the reels 14 at predetermined intervals.

The hopper 66 is installed in a cabinet 11, and a predetermined number of coins are paid out from the coin payout opening 19 to the coin tray 18, based upon the control signal output from the main CPU 41. A coin detecting section 67 is provided inside of the coin payout opening 19, and outputs an input signal to the main CPU 41, if it is detected that a predetermined number of coins have been paid out from the coin payout opening 19.

A graphic board 68 controls the images to be displayed on the upper and lower image display panels 33 and 16, based upon the control signal output from the main CPU 41. The activated paylines randomly determined through selection of random numbers are displayed, and also, symbols determined through selection of random number are displayed in a scrolling or stopped state, in the respective display blocks 28 on the lower image display panel 16. The number-of-credits display portion 31 on the lower image display panel 16 displays the number of credits stored in the RAM43. Further, the number-of-payouts display portion 32 on the lower image display panel 16 displays the number of coins to be paid out.

The graphic board 68 is provided with: a VDP (Video Display Processor), which generates image data, based upon the control signal output from the main CPU 41; and a video RAM, etc., which temporarily stores image data generated by the VDP. The image data used when the image data is generated by the VDP is read from the memory card 53, and thereafter, is included in the game programs stored in the RAM 43.

The bill validator 22 validates whether or not a bill is legitimate and accepts a legitimate bill in the cabinet 11. The bill validator 22, upon accepting a legitimate bill, outputs an input signal to the main CPU 41 based on the bill amount. The main CPU 41 stores in the RAM 43 the amount of credits responsive to the amount of bills transmitted by the input signal.

The ticket printer 35 prints, on tickets, bar codes containing the coded data such as the credit amount, date and time, and ID number of the gaming machine 10, stored in the RAM 43, based upon the control signal output from the main CPU 41, and then, outputs the bar code-attached tickets 39. The card reader 36 reads data from a smart card, thereby transmitting the read data to the main CPU 41 or writing data into the smart card, based upon the control signal from the main CPU 41. The key switch 38S is provided on the key pad 38, and outputs a predetermined input signal to the main CPU41 when a player operates the key pad 38. The control panel 20, a reverter 21S, a coin counter 21C, and a cold cathode-ray tube 81 are connected to the door PCB80.

To the door PCB 80, a control panel 20, a reverter 21S, a coin counter 21C, and a cold cathode-ray tube 81 are connected. On the control panel 20, there are provided: a spin switch 23S corresponding to a spin button 23; a change switch 24S corresponding to a change button 24; a CASHOUT switch 25S corresponding to a CASHOUT button 25; a 1-BET switch 26S corresponding to a 1-BET button 26; and a MAX-BET switch 27S corresponding to a MAX-BET button 27. The switches 23S to 27S output input signals to the main CPU 41 when the corresponding buttons 23 to 27 are operated by the player.

The coin counter 21C is provided inside of the coin insertion slot 21, and validates legitimacy of the coins inserted into the coin insertion slot 21 by the player. This coin counter discriminates whether a coin inserted by a player into the coin receiving slot 19 is valid or invalid. Those other than the valid coins are discharged from the coin payout exit 19. The coin counter 21C also outputs an input signal to the main CPU41 if a valid coin is detected.

The reverter 21 S is operable based upon the control signal output from the main CPU 41. This reverter distributes, the coins recognized to be legitimate by the coin counter 21C, into a cashbox (not shown) or a hopper 66 which was installed in the gaming machine 10. In other words, if the hopper 66 is filled with coins, the legitimate coins are distributed to the cashbox by means of the reverter 21S. Otherwise, the legitimate coins are distributed to the hopper 66. The cold cathode-ray tube 81 functions as a backlight installed at the rear side of the lower and upper image display panels 16 and 33, and lights based upon the control signal that was output from the main CPU 41.

Figure 6:
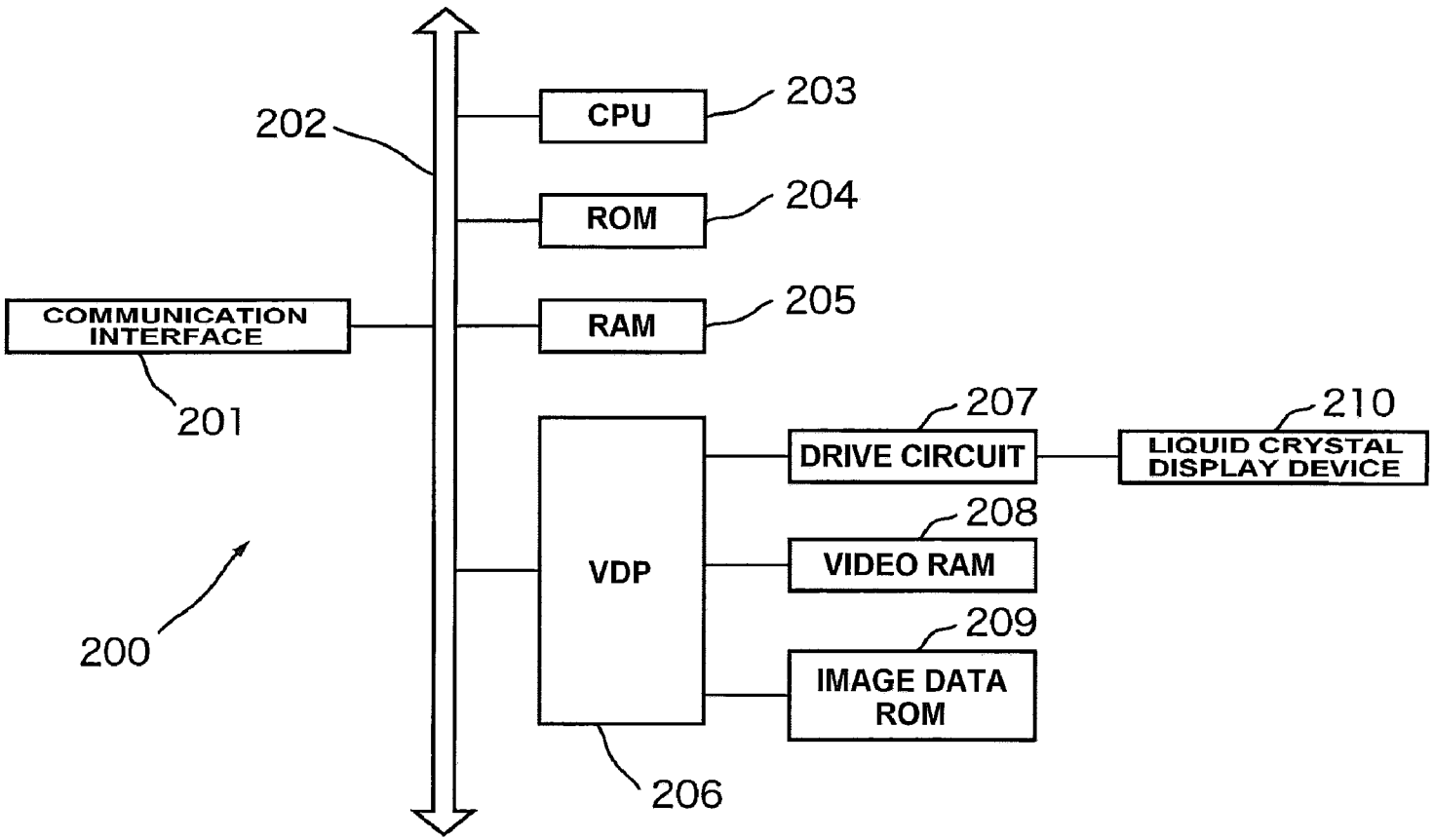
FIG. 6 is a block diagram depicting an internal configuration of a common display device.

FIG. 6 is a block diagram depicting an internal configuration of a common display device 200. The common display device 200 is connected to four gaming machines 10 in the embodiment, and is commonly used by each of the connected gaming machines 10. The common display device 200 is provided with: a communication interface 201; an input/output bus 202; a CPU 203; a ROM 204; a RAM 205; a VDC 206; a driving circuit 207; a video RAM 208; an image data ROM 209; and a liquid crystal display panel 210.

The communication interface 201 is intended for receiving signals or data, etc, which were transmitted from each of the gaming machines 10 and for transmitting required signals or data, etc., to each of the gaming machines 10. The signals or data, which were received at the communication interface 201, are notified to the CPU 203 via an input/output bus 202.

The ROM 204 stores display control programs for generating a drive signal supplied to the liquid crystal display 21, based upon an image display instruction issued by the CPU 203. On the other hand, the RAM 2005 stores values of flags or variables used by the above display control programs.

The VDP 206 is a processor which includes a split circuit, a screen circuit, and a pallet circuit, etc., and which is capable of performing various processing operations for displaying images on the liquid crystal display panel 210.

To the VDP 206, a video RAM 208 for storing image data responsive to the image display instruction issued by the CPU 203; and an image data ROM 209 storing data for displaying various effect images and explanatory images for explaining the contents of a game, are connected. Further, to the VDP 206, a driving circuit 207, which outputs a drive signal for driving the liquid crystal display panel 210, is also connected.

The CPU 203 of the common display device 200 reads and executes display control programs stored in the ROM 204 and reads, from an image data ROM 209, image data for images to be displayed. Then, this CPU causes a video RAM 20 to store the reading, and then, drives the driving circuit 207 through the VDP 206, thereby displaying images on the liquid crystal display panel 210.

Figure 7:
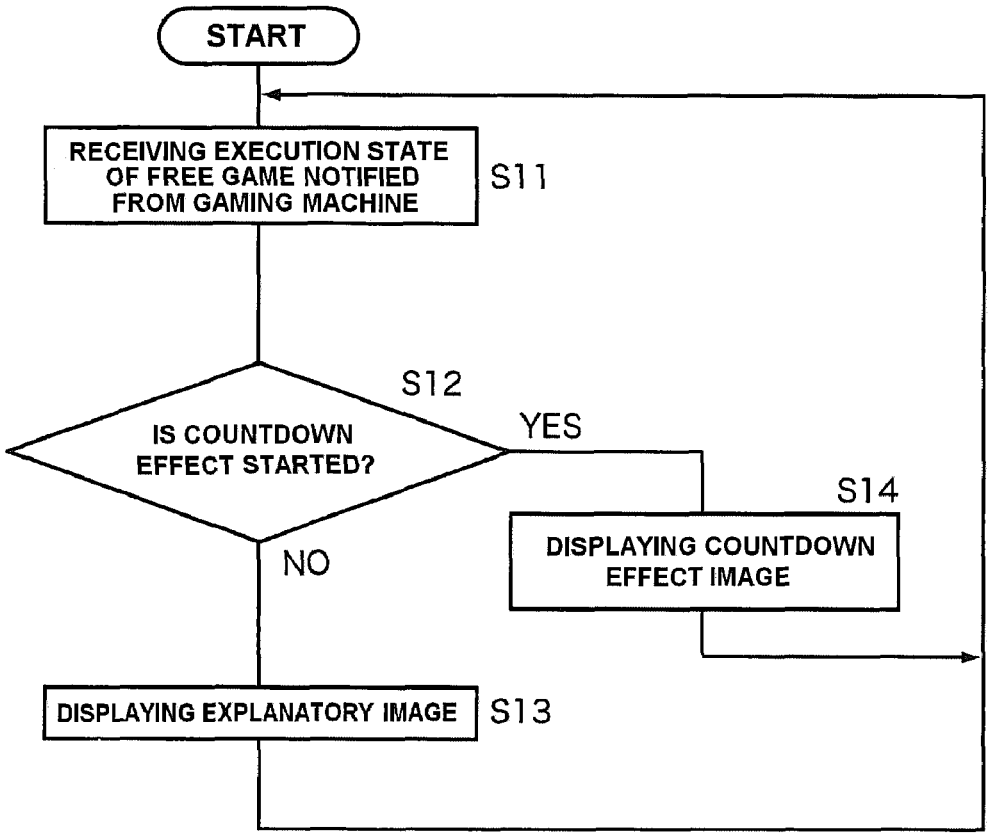
FIG. 7 is a flowchart showing procedures for executing processing in the common display device.

Hereinafter, processing operations, which are performed on the common display device 200, will be described. FIG. 7 is a flowchart showing operating procedures performed on the common display device 200. As a state of execution of a free game (second game) in the gaming machine 10, if the common display device 200 receives through a communication interface 200 a total game count C notified from the gaming machine (step S11), the CPU 203 of the common display device 200 judges whether or not there exists a gaming machine 10 in which the total game count C becomes a predetermined value Th1 or more by comparing the total game count C executed at each of the gaming machines 10 and the predetermined value Th1, based upon an identification number for identifying the gaming machine 10. In this manner, it is judged whether or not there exists a gaming machine 10 in which a countdown effect is started (step S12). If there does not exist a gaming machine 10 in which the total game count C becomes the first predetermined value Th1 or more, it is judged that a countdown effect is not started in any of the gaming machines 10 (S12: NO); a CPU 203 read an explanatory image from an image data ROM 209, causes a video RAM 208 to store the reading, and drives a drive circuit 207 through a VDP 206, thereby displaying an explanatory image 200*b* as shown in FIG. 1 on a liquid crystal display device 210 (step S13).

On the other hand, if there exists a gaming machine 10 in which the total game count C becomes the first predetermined value Th1 or more, it is judged that a countdown effect is started in any of the gaming machines 10 (S12: YES); the CPU 203 reads an explanatory image from an image data ROM 209, causes the video RAM 208 to store the reading, and then, drives the drive circuit 207 through the VDP 206, thereby displaying a countdown effect image 200*b* as shown in FIG. 1 on the liquid crystal display device 210 (step S14).

As described above, in the present embodiment, a configuration is employed to always display any image on the common display device 200, a period in which the common display device 200 is not used can be eliminated, and hardware resources can be effectively utilized.

Further, an explanation of the contents of games is furnished on the common display device 200, thereby making it possible to attract interest or concern of those who do not play games. Further, if a new game is introduced, announcement of this game can be performed.

Figure 8:
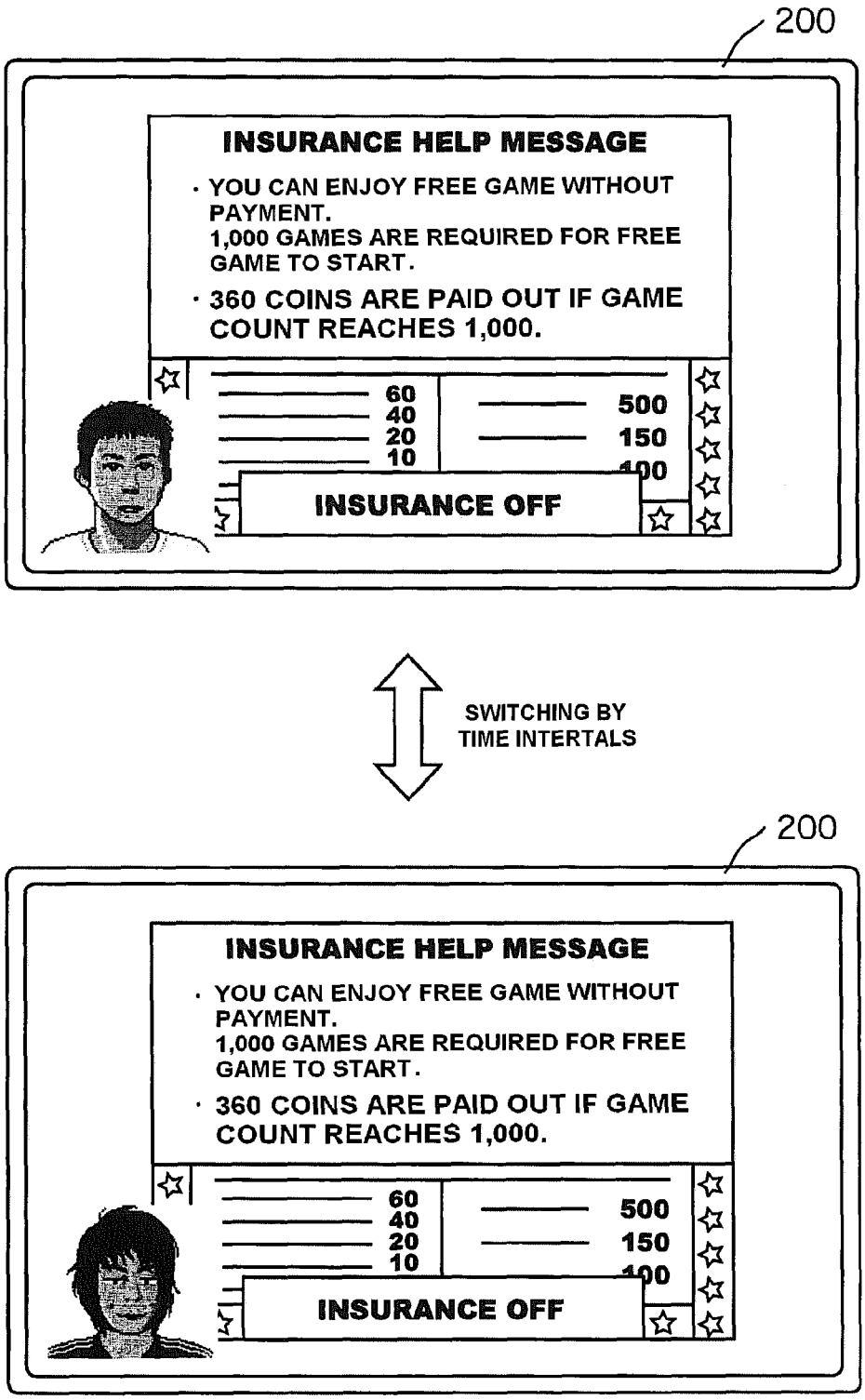
FIG. 8 is a schematic view showing another exemplary image displayed on the common display device according to the present embodiment.

FIG. 8 is a schematic view showing another exemplary image displayed on the common display device according to the present embodiment. In the example shown in FIG. 8, there is shown how an explanatory image including one animation character 2A and an explanatory image including another animation character 2B are alternately displayed while they are changed by time (for example, by 2 seconds). The animation characters included in the explanatory images are not limitative to those which simulate human animation characters as shown in FIGS. 1 and 8. Further, an explanatory image, which is not inclusive of any animation character, may be displayed.

Figure 9:
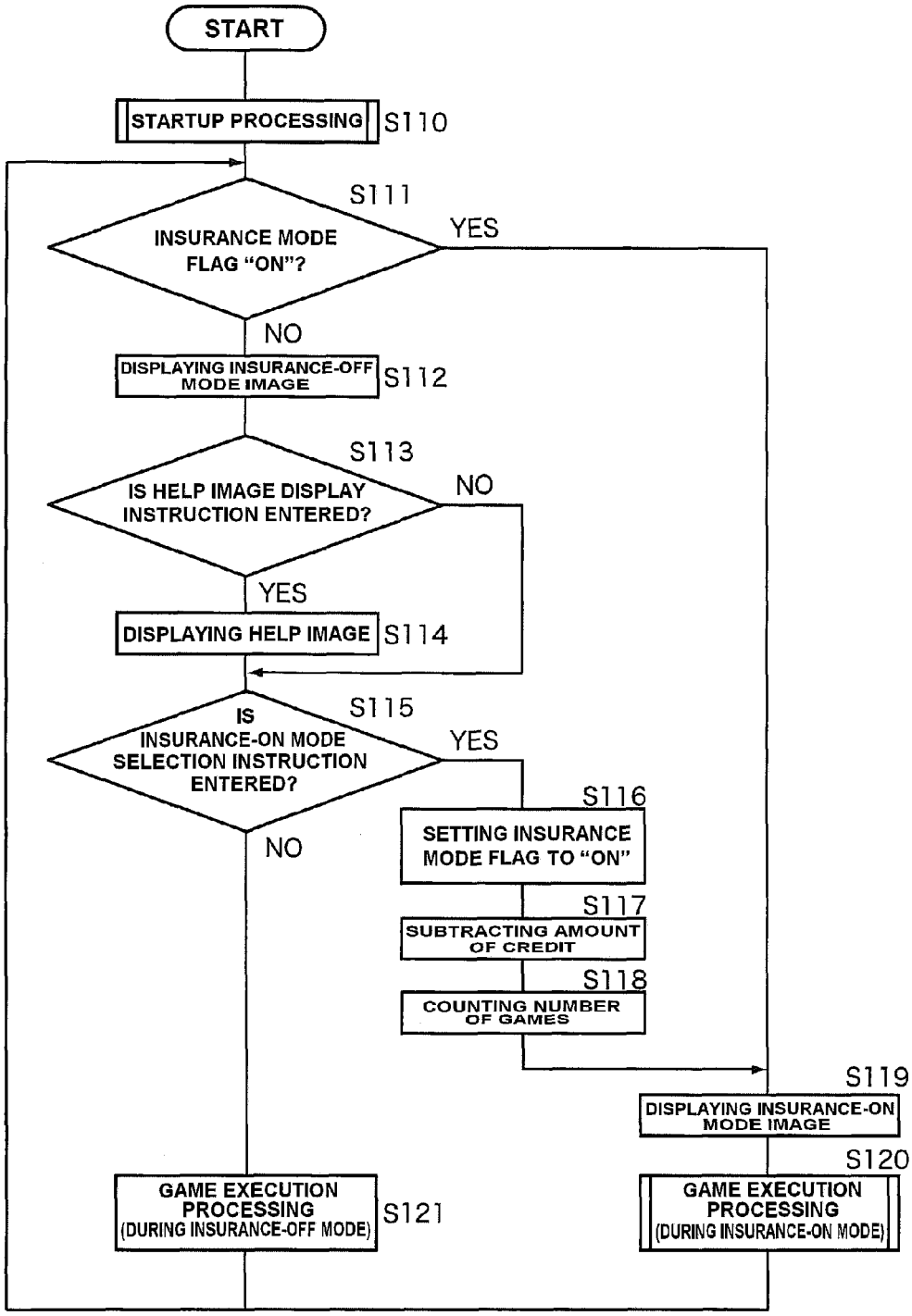
FIG. 9 is a flowchart showing procedures for executing main processing at the gaming machine.

Hereinafter, the processing operations executed by each of the gaming machines 10 will be described. FIG. 9 is a flowchart showing procedures for executing main processing in the gaming machine 10. First, startup processing is performed in the gaming machine 10 (step S110). The startup processing will be described later in detail. While this subroutine is executed, the main CPU 41 performs processing of adding the credit amount stored in the RAM 43 as interruption processing, upon the receipt of a detection signal output from the coin counter 21C when the coin counter 21 C detects the coins inserted into the coin insertion slot 21.

First, the main CPU 41 judges whether or not the insurance-on mode flag stored in the RAM 43 is set to "ON" (step S111). If this insurance-on mode flag is not set to "ON", i.e., if it is set to "OFF", this CPU performs processing of displaying insurance-offmode images (step S112). In this processing operation, the main CPU 41 transmits an instruction for graphically plotting insurance-off mode images to a graphic board 68. On the graphic board 68, based upon the abovementioned graphic plotting instruction, the VDP samples image data from the RAM 43 and decompresses the sampled data on the video RAM. Further, the VDP generates image data of one frame, and then, outputs this image data to the upper and lower image display panels 33 and 16. As the result thereof, the upper and lower image display panels 33 and 16 display the images as shown in FIG. 10, for example.

Figure 10:
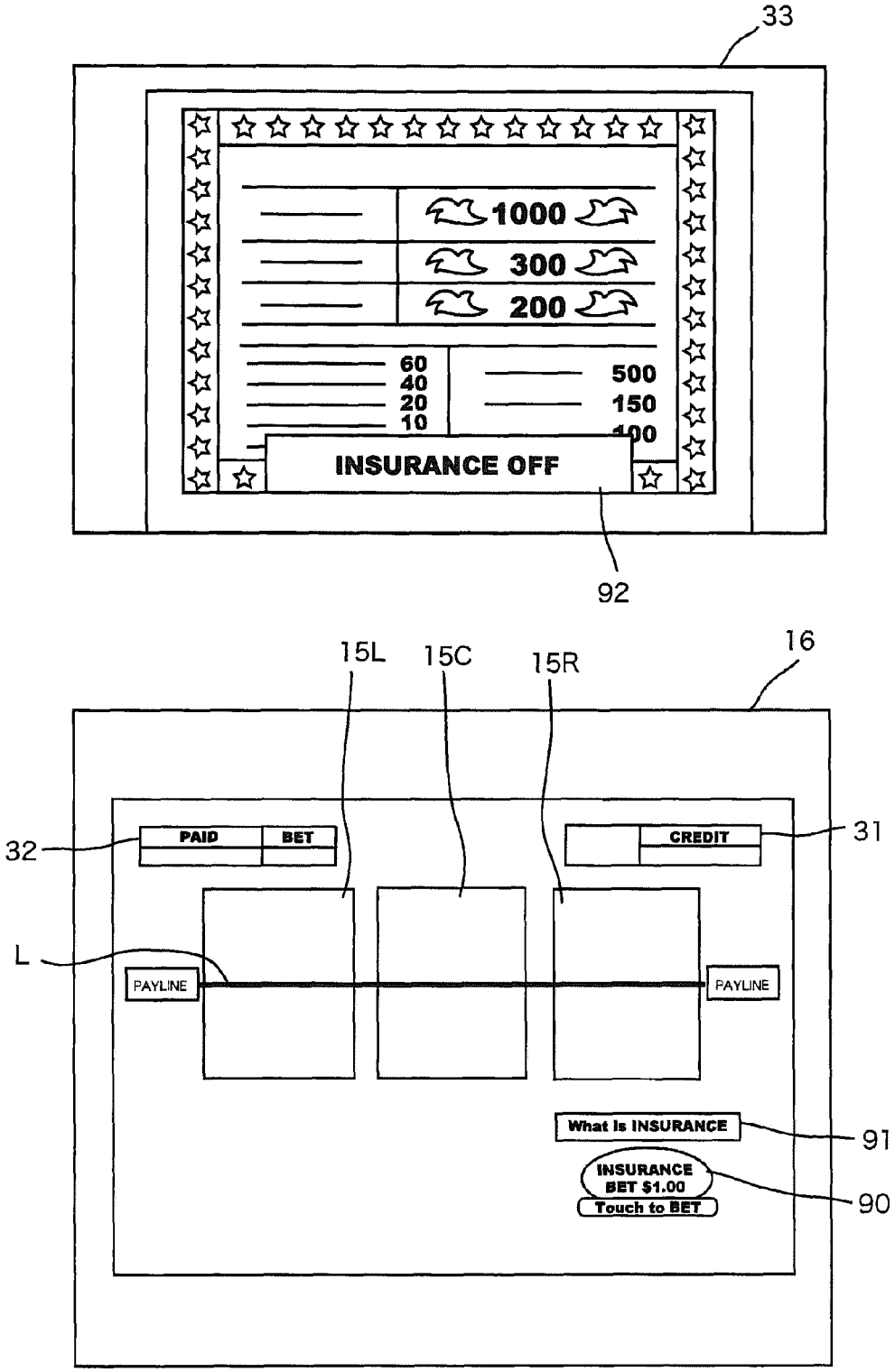
FIG. 10 is a view showing exemplary images displayed on the upper and lower image display panels in the insurance-off mode.

FIG. 10 is a view showing exemplary images displayed on the upper and lower image display panels in the insurance-off mode. In the figure, reference numerals 15 (15L, 15C, 15R) denote display windows. Reference numeral 31 denotes a credit amount display section. Reference numeral 32 denotes a payout number display section. Uppercase letter L denotes a payline. An image 90, which is indicative of "INSURANCE BET $1.00 TOUCH TO BET", is displayed at the lower right part of the lower image display panel 16. The image 90 is an image for requesting a player to select an insurance-on mode and to enter game mediums required to select the mode. A player can enter an instruction for selecting an insurance-on mode, by touching a predetermined site of a touch panel 69 corresponding to a display area of the image 90.

In order to select the insurance-on mode, a predetermined credit amount (1 dollar in the embodiment) is required. In place of the credit amount, bills or coins equivalent thereto may be inserted. If the instruction for selecting the insurance-on mode has not been entered, the insurance-off mode is selected.

Upwardly of the image 90, an image, which is indicative of "WHAT IS INSURANCE?", is displayed. The image 91 is intended for entering an instruction for displaying a help image. A player can enter the instruction for displaying the held image, by touching the predetermined site of the touch panel 69 corresponding to the display area of the help image. An image 92, which is indicative of "INSURANCE OFF", is displayed at the lower part of the upper image display panel 33. The image 92 is indicative of the fact that a game mode is an insurance-off mode.

Following the completion of the processing at step S112, the main CPU 41 judges whether or not an instruction for displaying a help image has been entered (step S113). The instruction for displaying the help image is entered when the player touches the predetermined site of the touch panel 69 corresponding to the display area of the image 91, as described above.

If the above instruction is entered, processing of displaying the help image is performed (step S114). In this processing operation, the main CPU 41 transmits a graphical plotting command of a help image to the graphic board 68. The graphic board 68 performs processing of displaying images on the upper and lower image display panels 33 and 16, based upon the abovementioned graphic plotting command. As the result thereof, the upper and lower image display panels 33 and 16 display the images as shown in FIG. 11, for example.

Figure 11:
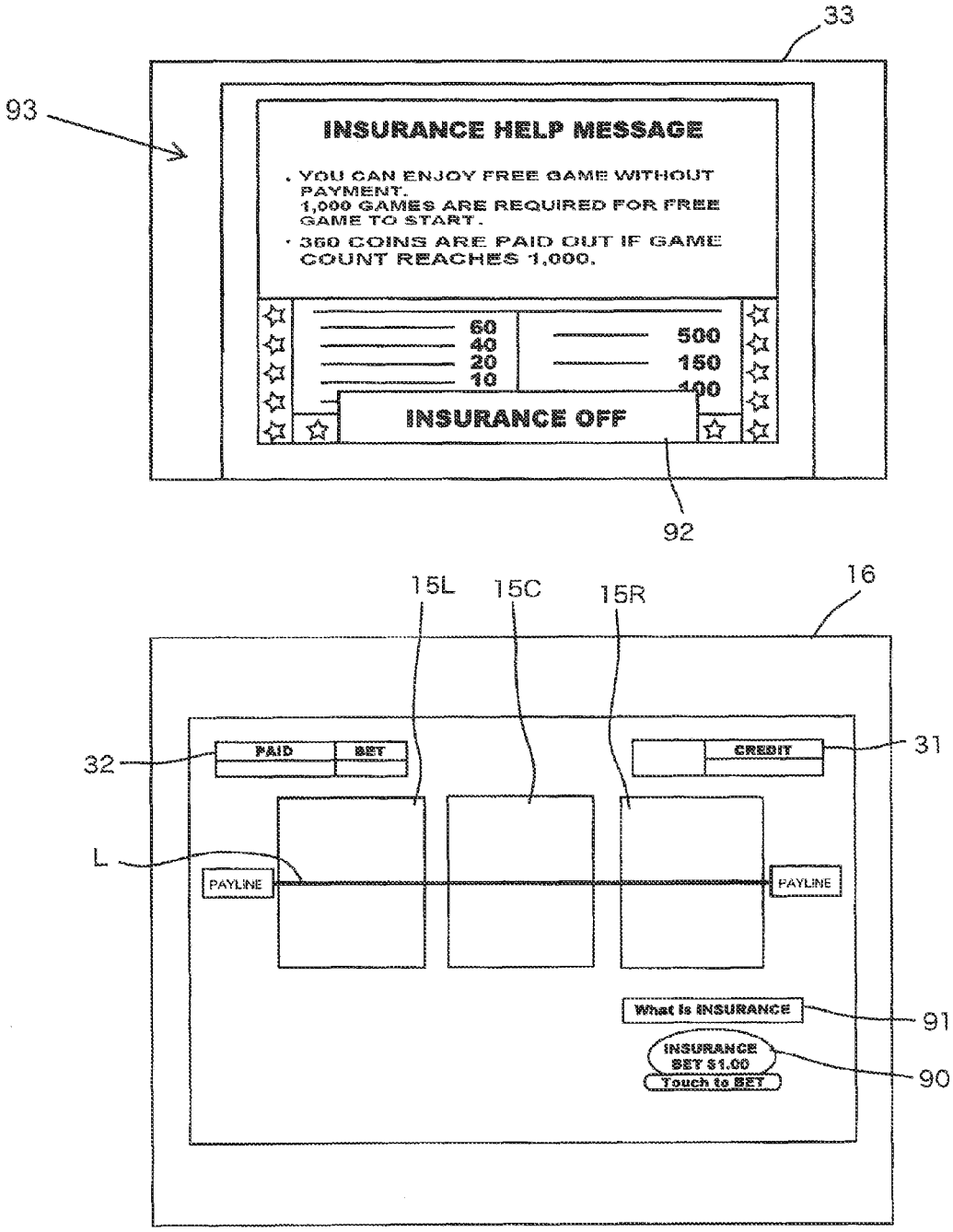
FIG. 11 is a view showing exemplary images displayed on the upper and lower image display panels in the insurance-off mode.

FIG. 11 is a view showing exemplary images displayed on the upper and lower image display panels in the insurance-off mode. The images displayed on the upper and lower image display panels 33 and 16 are substantially identical to those shown in FIG. 10, and are different from those of FIG. 10 in that the help image 93 is displayed at the upper part of the upper image display panel 33. The help image is an image for explaining (a) the number of times of executing games until a free game (rescue pay) is started; and (b) the number of coins (360) paid when the number of times of executing games reaches a specific value. The help image 93 indicates an explanatory statement of the insurance-on mode. The help image 93 shown in FIG. 11 disappears when a predetermined period of time (10 seconds, for example) has elapsed after displayed.

If the processing at the step S114 is executed, or alternatively, if the instruction for displaying the help image is not entered, the main CPU 41 judges whether or not the instruction for selecting the insurance-on mode has been entered (step S115). The instruction for selecting the insurance-on mode is entered when the player touches the predetermined site of the touch panel 69 corresponding to the display area of the image 90, as described above.

When the instruction for selecting the insurance-on mode has been entered, the main CPU 41 sets to "ON" the insurance-on mode flag stored in the RAM 43 (step S116). Subsequently, the main CPU 41 performs processing of subtracting a predetermined amount (credit amount equivalent to 1 dollar in the embodiment) from the credit amount stored in the RAM 43 (step S117), and then, starts counting the game count C (step S118). At this time, the main CPU 41 sets the total game count C to zero.

If it is judged that the insurance-on mode flag is set to "ON" at step 111, or alternatively, if the processing at step S118 is executed, the processing of displaying the insurance-on mode image is performed (step S119). In this processing operation, the main CPU 41 transmits a command for graphically drawing the insurance-on mode image to the graphic board 68. On the graphic board 68, based upon the abovementioned graphic plotting command, the VDP samples image data from the RAM 43 (storage device) and decompresses the sampled data on the video RAM. Further, the VDP generates image data of one frame, and then, outputs this image data to the upper and lower image display panels 33 and 16. As the result thereof, the upper and lower image display panels 33 and 16 display the images as shown in FIG. 12, for example.

Figure 12:
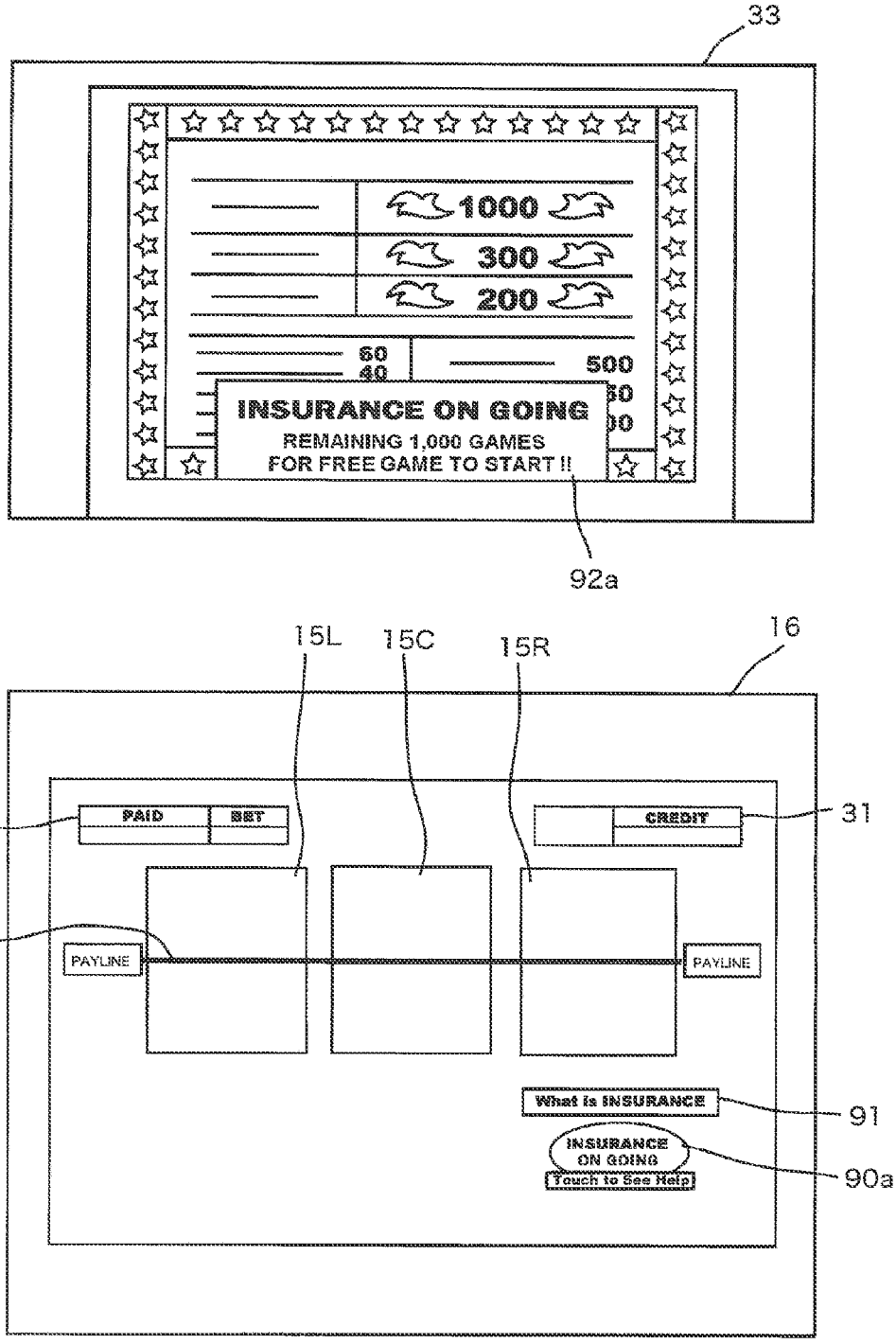
FIG. 12 is a view showing exemplary images displayed on the upper and lower image display panels during an insurance-on mode.

FIG. 12 is a view showing exemplary images displayed on the upper and lower image display panels in the insurance-on mode. At the lower right part of the lower image display panel 16, an image 90*a*, which is indicative of "INSURANCE IS ONGOING! TOUCH TO SEE HELP", is displayed in place of the image 90 (see FIG. 10). The image 90*a* is indicative of the fact that the game mode is the insurance-on mode, and is intended for entering the instruction for displaying the help image. The player can enter the instruction for displaying the help image by touching the predetermined site of the touch panel 69 corresponding to the display area of the image 90*a*. At the lower part of the upper image display panel 33, an image 92*a* is displayed which is indicative of "INSURANCE IS ONGOING! 1,000 TIMES STILL REMAIN UNTIL FREE GAME IS STARTED". The image 92*a* is indicative of the fact that the game mode is the insurance-on mode.

After the processing at step S119, the main CPU 41 performs game execution processing during the insurance-on mode (step S120). This processing operation will be described later with referring to FIG. 13.

If the instruction for selecting the insurance-on mode is not entered at step S115, the main CPU 41 performs game execution processing during the insurance-off mode (step S121). This processing operation is substantially similar to the game execution processing (see FIG. 13) during the insurance-on mode, except that processing relevant to counting the number of times of executing games, and thus, a duplicate description is omitted here. While in the insurance-off mode, the image 92 is displayed on the upper image display panel 33, and the images 90, 91 are displayed on the lower image display panel 16. If the processing at step S120 or S121 is executed, the routine then reverts to step S111.

While the embodiment described a case in which the upper and lower image display panels 33 and 16 display the images 90*a*, 92*a* for notifying a transfer to the insurance-on mode, a sound for notifying the transfer to the insurance-on mode may be output from the speaker 29, in the present invention.

Figure 13:
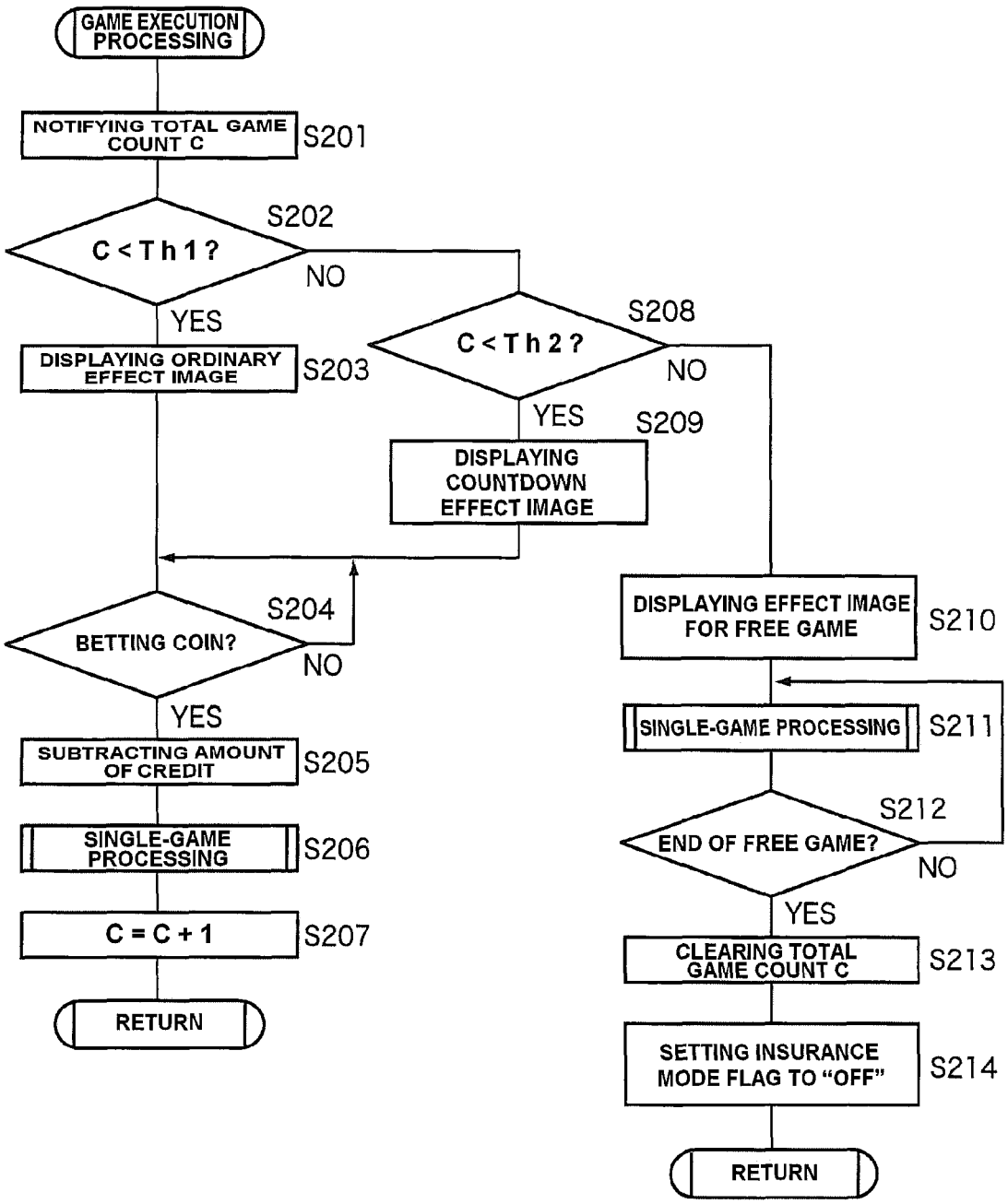
FIG. 13 is a flowchart showing procedures for performing games during the insurance-on mode.

Next, a game execution process while in an insurance-on mode read at step S120 of the main routine shown in FIG. 9 will be described. FIG. 13 is a flowchart showing procedures for performing games during the insurance-on mode; First, the main CPU 41, together with the ID number assigned thereto, notifies the current total game count C to a common display device 200, through a communication interface 44 (step S201).

Subsequently, the main CPU 41 judges whether or not the current total game count C is less than the abovementioned first predetermined value Th1 (990 in the embodiment) (step S202). If it is judged that the current total game count C is less than the first predetermined value Th1 (S202: YES), processing of displaying a normal effect image is performed (step S203). In this processing operation, the main CPU 41 transmits a command for graphically drawing normal effect images to the graphic board 68. On the graphic board 68, based upon the abovementioned graphics-drawing command, the VDP samples image data from the RAM 43; decompresses the sampled data on the video RAM; generates image data for one frame; and then, outputs the image data to the lower image display panel 16. As the result thereof, the lower image display panel 16 displays a normal effect image. This normal effect image is different from the abovementioned countdown effect image, and is intended for augmenting a base game.

Next, it is judged whether or not coins are betted (step S204). In this processing operation, the main CPU 41 judges whether or not an input signal output from a 1-BET switch 26S when a 1-BET button 26 is operated or that output from a MAX-BET switch 27S when a MAX-BET button 27 is operated has been received. If it is judged that no coins are betted (S204: NO), the routine reverts to step S204.

If it is judged that coins are betted at step S204 (S204: YES), the main CPU 41 performs processing of subtracting the credit amount stored in the RAM 43, in accordance with the number of betted coins (step S205). If the number of coins to be betted is greater than the credit amount stored in the RAM 43, this CPU does not perform the subtraction processing, and the routine reverts to step S204.

Subsequently, the main CPU 41 executes single-game processing described later (step S206). Procedures for performing the single-game processing will be described later. A game is executed in which, while it is triggered that the SPIN button 23 is turned ON by the player, rotational control of the reels 14 and processing of determining symbols to be stopped are performed, and a payment is made in accordance with stopped symbols or a combination thereof. After the end of this single-game processing, the main CPU 41 increments, by 1, the value of total game count C to be stored in the RAM 42 (step S207). After that, the current step reverts to the main routine shown in FIG. 9.

If it is judged that the current total game count C is not smaller than the first predetermined value Th1 (S202: NO), the main CPU 41 judges whether or not the current total game count C is smaller than the second predetermined value Th2 (1,000 in the embodiment) (step S208). If it is judged that the current total game count C is equal to or greater than the first predetermined value Th1 and is smaller than the second predetermined value Th2 (S208: YES), processing of displaying a countdown effect image is performed (step S209). In this processing operation, the main CPU 41 transmits a command for graphically drawing the countdown effect image to the graphic board 68. On the graphic board 68, based upon the abovementioned graphics-drawing command, the VDP samples image data from the RAM 43; decompresses the sampled data on the video RAM; generates image data for one frame; and then, outputs the image data to the lower image display panel 33. As the result thereof, a countdown effect image as shown in FIG. 1 is displayed on the upper image display panel 33. Thereafter, the routine proceeds to the abovementioned step S204, and then, a base game is implemented.

If it is judged that the current total game count C reached the second predetermined value Th2 at step S208 (S208: NO), the free game as described above is started. Because the total game count C reached the second predetermined value Th2, processing is performed for displaying free game-destined effect images such as images which are indicative of the fact that a predetermined number of coins (360 in the embodiment) are paid out as a rescue pay and those which are indicative of the remaining free game count (step S210). In this processing operation, the main CPU 41 transmits a command for graphically drawing free game-destined effect images to the graphic board 68. On the graphic board 68, based upon the abovementioned graphics-drawing command, the VDP samples image data from the RAM 43; decompresses the sampled data on the video RAM; generates image data for one frame; and then, outputs the image data to the lower image display panel 33. As the result thereof, an effect image for a free game is displayed on the upper image display panel 33.

Next, the single game processing described later is executed (step S211). Procedures for performing the single-game processing will be described later. A game is executed in which, while it is triggered that the SPIN button 23 is turned ON by the player, rotational control of the reels 14 and processing of determining symbols to be stopped are performed, and a payment is made in accordance with stopped symbols or a combination thereof.

The main CPU 41 judges whether or not to terminate a free game by judging whether or not the number of times of executing the single-game processing at step S211 executed as a free game reached a predetermined number of times (step S212). If it is judged that the free game is not terminated (S212: NO), the routine reverts to S211. If it is judged that the game is terminated (S212: YES), the main CPU 41 clears the total game count C stored in the RAM 42 (step S213), and set the insurance mode flag to OFF (step S214). After that, the current step reverts to the main routine shown in FIG. 9.

While the present embodiment described the configuration in which every time a base game is implemented, the total game count C is notified to the common display, a configuration may be provided in which, if the number of times of executing base games reached a specific number of times which is equal to or smaller than the first predetermined value Th1 (third predetermined value, for example, 899), the total game count C is notified. In this case, only in the case where a countdown effect is oncoming, communication between the gaming machine 10 and the common display device 200 is performed, thus making it possible to reduce a communication volume therebetween.

Figure 14:
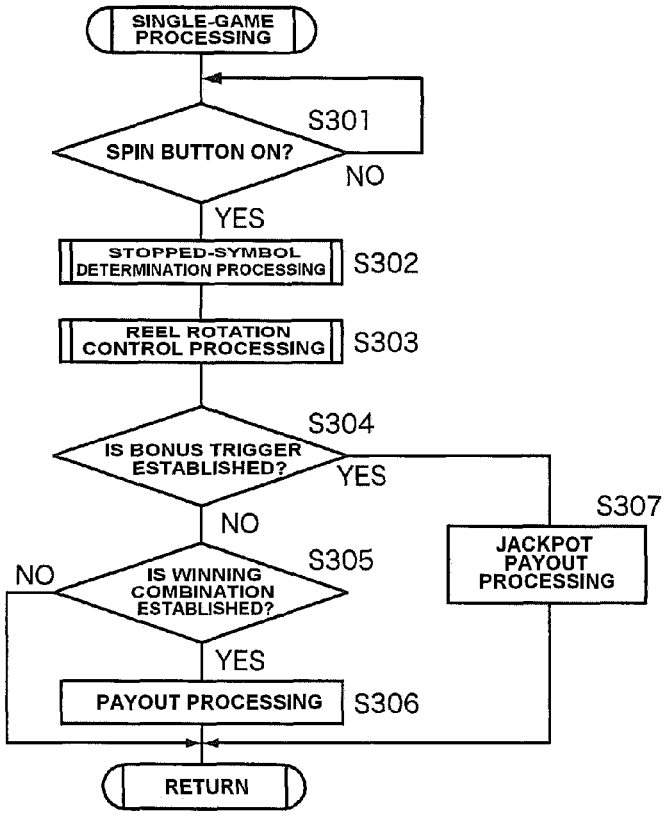
FIG. 14 is a flowchart showing procedures for executing single-game processing.

Next, single-game processing invoked at steps S206 and S211 of the subroutine shown in FIG. 13 will be described. FIG. 14 is a flowchart showing procedures for executing single-game processing. First, the main CPU 41 judges whether or not the SPIN button 23 has been turned ON (step S301). In this processing operation, the main CPU 41 judges whether or not the input signal output from the SPIN switch 23S has been received when the SPIN button 23 has been depressed. If it is judged that the SPIN button 23 has not been turned ON (step S310: NO), the routine reverts to step S301. If the SPIN button 23 has not turned ON (for example, if an instruction for terminating a game without turning ON the SPIN button 301 is entered), the main CPU 41 cancels a subtraction result at step S205.

While the present embodiment describes a case of performing processing of subtracting the credit amount before judging whether or not the SPIN button 23 has been turned ON after coins have been betted, the present invention is not limitative thereto. For example, it may be a routine to perform processing of judging whether or not the SPIN button 23 has been turned ON after coins have been betted, and then, subtracting the credit amount in the case where the judgment result is affirmative.

If it is judged that the SPIN button 23 has been turned ON at step S301 (S301: YES), the main CPU 41 performs stopped-symbol determination processing (step S302). In this stopped-symbol determination processing, the main CPU 41 determines code No. at the stoppage of each of the reels 14 by executing the stopped-symbol determination program stored in the RAM 43. In this manner, a combination of symbols displayed in a stopped state is determined. A detailed description thereof will be given later.

While the present embodiment describes a case of determining one winning combination from among plural kinds of winning combinations by determining a combination of symbols displayed in a stopped state, for example, in the present invention, it may be a routine to determine one winning combination randomly selected from among plural kinds of winning combinations with the use of random number values, and thereafter, determine the combination of the symbols displayed in a stopped state, based upon the abovementioned winning combination.

Next, the main CPU 41 performs reel rotation control processing (step S303). This processing operation is intended to stop rotation of each reel, so that a combination of specific symbols corresponding to the winning combination determined at step S302 is displayed in a stopped state on the payline L after rotation of all of the reels 14 is started. A detailed description thereof will be given later.

Next, the main CPU 41 judges whether or not a bonus game trigger has been established (step S304). If the judgment result is affirmative (S304: YES), any one jackpot is selected from among four different types of jackpots "GRAND", "MAJOR", "MINOR", and "MINI" with the use of random number values, and a predetermined number of coins for such jackpot are paid out (step S307). If coins are stored, the main CPU 41 performs processing of adding an amount of credit stored in the RAM 43. On the other hand, if coins are paid out, the main CPU 41 transmits a control signal to the hopper 66 to pay out a predetermined number of coins. At that time, a coin detecting section 67 counts the number of coins paid out from the hopper 66, and then, transmits a payout completion signal to the main CPU 41 when the counted value reached a specified number. In this manner, the main CPU 41 stops driving the hopper 66, and then, terminates coin payout processing.

If no bonus game trigger is established at step S304 (S304: NO), the main CPU 41 judges whether or not a winning combination is realized (step S305). If the judgment result is affirmative (S305: YES), the main CPU 41 pays out coins according to the number of inserted coins and the realized winning combination (step S306). If it is judged that no winning combination is realized in step 305, or alternatively, if the processing at step S306 or S307 is executed, this subroutine is terminated.

Figure 15:
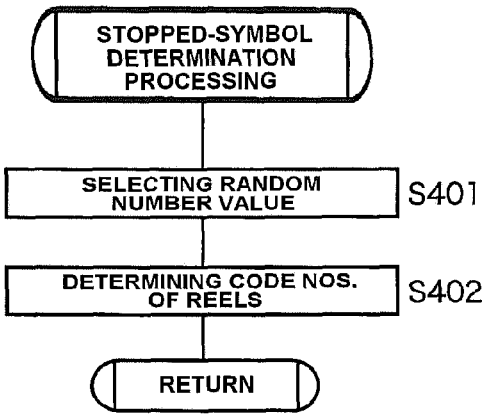
FIG. 15 is a flowchart showing procedures for determining symbols to be stopped.

Next, the stopped-symbol determination processing invoked at step S302 of the subroutine shown in FIG. 14 will be described. FIG. 15 is a flowchart showing procedures for determining symbols to be stopped. This processing is performed by the main CPU 41 executing the stopped-symbol determination program stored in the RAM 43. First, the main CPU 41 selects a random number value that corresponds to each of the three reels 14, from among a numeric range of 0 to 255, by executing a program for generating random numbers, which is included in the stopped-symbol determination programs (step S401). The present embodiment describes a case of generating random numbers in a programmable fashion (a case of using so called software random numbers). In the present invention, however, a random number generator is provided, whereby random numbers may be sampled from the random number generator (so called hardware random numbers may be used).

Next, the main CPU 41 (processor) refers to symbol-weighted data according to the payout rate setting data that is output from the GAL 54 and stored in the RAM 43 (storage device), and then, determines code No. (see FIG. 3) of each of the reels 14, based upon the selected three random number values (step S402). Code Nos. of each of the reels 14 correspond to code Nos. of symbols displayed in a stopped state on the payline L. Reel rotation control processing described later is performed based upon code Nos. of these reels.

Figure 16:
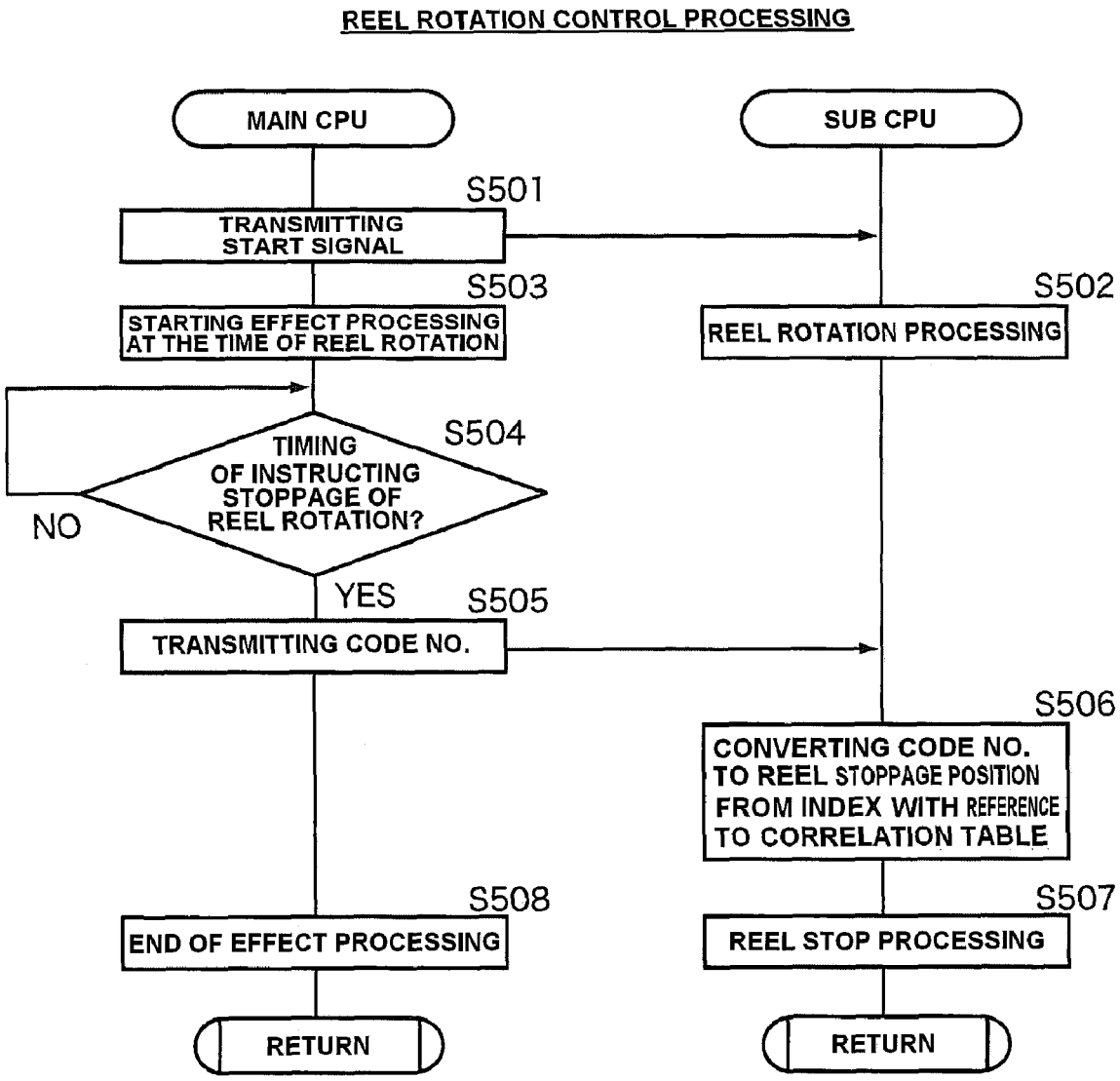
FIG. 16 is a flowchart showing procedures for executing reel rotation control processing.

Next, the reel rotation control processing invoked at step S303 of the subroutine shown in FIG. 14 will be described. FIG. 16 is a flowchart showing procedures for executing reel rotation control processing. This processing operation is performed between the main CPU 41 and a sub CPU 61.

First, the main CPU 41 transmits to the sub CPU 61 a start signal for storing reel rotation (step S501). Upon the receipt of the start signal from the main CPU 41, the sub CPU 61 performs reel rotation processing (step S502). In this processing operation, the sub CPU 61 supplies pulses to the motor drive circuit 62. The pulses outputted from the sub CPU 61 are amplified by means of the driver 64, and the amplified pulses are supplied to stepping motors 70 (70L, 70C, 70R). As the result thereof, each of the stepping motors 70 rotates, and concurrently, each of the reels 14 (14L, 14C, 14R) rotates. The stepping motors 70 of 1-2 phase excitation systems have a stepping angle of 0.9 degrees, and the number of steps per rotation is 400. Therefore, if 400 pulses are supplied to each of the stepping motors 70, each of the reels 14 makes one rotation.

At the time of starting rotation of the reels 14, the sub CPU 206 supplies pulses having low frequencies to the motor driving circuit 62, and then, gradually increases the frequencies of the pulses. Concurrently, the rotation speed of each of the reels 14 increases. When a predetermined time has elapsed, the frequencies of the pulses are made uniform. As the result thereof, each of the reels 14 rotates at a constant speed.

Figure 17A:
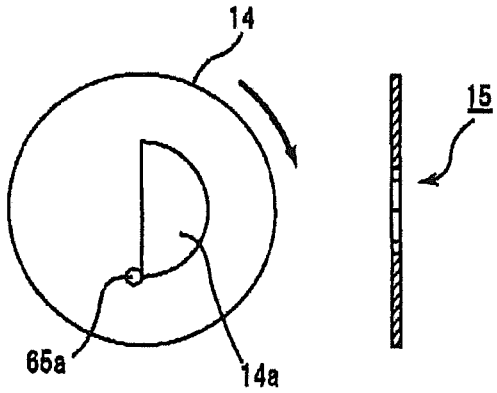
FIGS. 17A, 17B, 17C, and 17D are side views for explaining reel rotating operation.

Now, rotating operation of each of the reels 14 will be described with reference to FIGS. 17A-17D. FIGS. 17A-17D are side views for explaining reel rotating operation. As shown in FIG. 17A, a semicircular metal plate 14*a* is provided at a side face of each of the reels 14. The metal plate 14*a* rotates with each of the reels 14. Further, 22 symbols are provided on the peripheral face of each of the reels 14. Among the 22 symbols drawn on the peripheral face of each of the reels 14, three symbols can be visually recognized via a display window 15 formed in front of each of the reels 14. In the figure, the thick arrow indicates the rotational direction of each of the reels 14. Further, a proximity sensor 65*a* is provided laterally of each of the reels 14. The proximity sensor 65*a* is intended to detect the metal plate 14*a*. The proximity sensor 65*a* neither moves nor rotates, even if each of the reels 14 rotates.

Figure 17B:
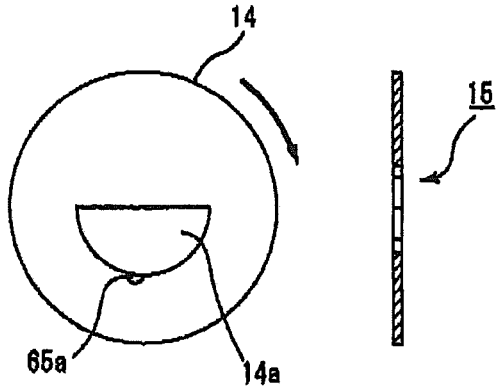
Figure 17C:
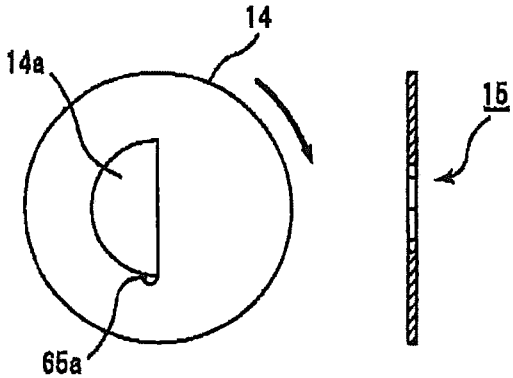

FIG. 17A shows a position (hereinafter, referred to as a "position A") of the metal plate 14*a* at a time point at which the plate is about to be detected by means of a proximity sensor 65*a*. If the reels 14 rotate when the metal plate 14*a* is set at the position A, this plate moves to the position shown in FIG. 17B. FIG. 17B shows a position (hereinafter, referred to as a "position B") of the metal plate 14*a* when the plate is detected by means of the proximity sensor 65*a*. If the reels 14 rotate when the metal plate 14*a* is set at the position B, the metal plate 14*a* moves to the position shown in FIG. 17C. FIG. 17C shows a position (hereinafter, referred to as a "position C") of the metal plate 14*a* at a time point at which the plate is not detected by means of the proximity sensor 65*a*.

Figure 17D:
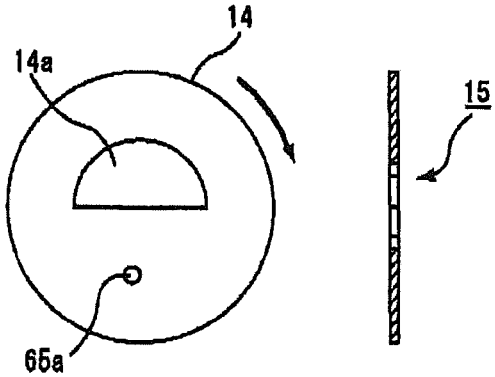

If each of the reels 14 rotates when the metal plate 14*a* is set at the position C, the plate moves to the position shown in FIG. 17D. The figure shows a position (hereinafter, referred to as a "position D") of the metal plate 14*a* when it is not detected by means of the proximity sensor 65*a*. If the reels 14 further rotate, the metal plate 14*a* reverts to the position A. As described above, the plate 14*a* is sequentially shifted to positions A, B, C, D, and then, to A, together with rotation of the reels 14.

The proximity sensor 65*a* constitutes an index detection circuit 65 (see FIG. 4). Assuming that a state in which the proximity sensor 65*a* is detecting the metal plate 14*a* is established at "High" and a state in which such detection is not being performed is established at "Low", when the metal plate 14*a* is shifted to the positions C, D, and then, to A, the state of the index detection circuit 65 is established at "Low". The sub CPU 61 recognizes the rotational position of each of the reels 14 while a rising edge from "Low" to "High" is defined as an index (origin) 1 and a falling edge from "High" to "Low" is defined as an index (origin) 2.

The main CPU 40 executes an effect at the time of reel rotation after transmitting a start signal to the sub CPU 61 at step S40 (step S503). This processing operation is intended to display an image on the lower image display panel 16 or outputs a sound from the speaker 29, over a period (3 seconds, for example) which is defined responsive to a result, etc. of the abovementioned stopped-symbol determination processing.

Next, the main CPU 40 judges whether or not a timing of instructing rotation stop of the reels 14 is established (step S504). The timing of instructing stoppage of rotation of the reels 14 denotes an earlier timing by the time minimally required to stop the rotation of the reels 14. The time minimally required to stop rotation of the reels 14 is predetermined.

If the judgment result at step S504 is negative (S504: NO), the routine restarts from the same step at which the effect at the time of reel rotation is continuously provided. If the result is affirmative (S504: YES), the main CPU 41 transmits, to the sub CPU 61, code Nos. of the reels which were stored in the RAM 43 (step S505). Upon the receipt of code Nos. of reels from the main CPU 41, the sub CPU 61 converts the code Nos. to the stop positions of reels from index (step Nos.), based upon a correlation table between the number of steps and code Nos. stored in the ROM (not shown) included in the sub CPU 61.

FIG. 18 is a schematic view showing a correlation table between the number of steps and code Nos. For code Nos., the corresponding indexes and the number of steps are associated with each other. Code Nos. correspond to the symbols drawn on the outer periphery of reels 14, and the symbols of code Nos. "00" to "10" correspond to index 1, and those of code Nos. Further, the symbols of code Nos. 11 to 21 correspond to index 2. Furthermore, the number of steps in the correlation table shown in FIG. 18 is the number of steps determined while index 1 is defined as a reference. For example, if code No. is "08", 145 steps from index 1 are equivalent to reel stop positions. Further, if code No. is "12", 218 steps from index 1 are equivalent to reel stop positions.

Next, the sub CPU 61 executes reel stop processing (step S507). In this processing operation, the sub CPU 61 detects, for each of the reels 14, a rising edge (index 1) from "Low" to "High" in the index detection circuit 65. Then, this sub CPU supplies to the motor driving circuit 65 the pulses which are equivalent to the number of steps converted from code Nos. at step S52, with a timing with which index 1 was detected. After that, the sub CPU stops supplying pulses.

For example, at step S506, if the reel stop position is determined to be 145 steps from index 1, the sub CPU 61 supplies 145 pulses to the motor driving circuit 65 with the timing with which index 1 was detected. After that, this sub CPU stops supplying pulses. Further, at step S52, if the reel stop position is determined to be 21 steps from index 1, the sub CPU 61 supplies 218 pulses to the motor driving circuit 65, with the timing with which index 1 was detected. As the result thereof, the reels 14 stop as per code No. determined at step S402 of FIG. 15, and a combination of symbols corresponding to a winning combination determined at step S402 of FIG. 15 is displayed in a stopped state. On the other hand, the main CPU 41 terminates an effect rendered at the time of reel rotation (step S508). After terminating the processing operations at steps S507 and S508, the main CPU 41 terminates this processing operation.

If the index corresponding to code No. transmitted at step S505 is different from that detected by means of the index detection circuit 65 when rotation of the reels 14 has stopped, step-out of the reels 14 arises. Thus, the main CPU 41 performs processing, for example, of displaying an error message on the lower image display panel 16, and then, cancels a game. For example, this CPU cancels a game, if index 1 is detected by means of the index detection circuit 65 when rotation of the reel 14L has stopped in spite of the fact that the processing of stopping the reel 14L with code No. 12 corresponding to index 2 was performed.

Figure 19:
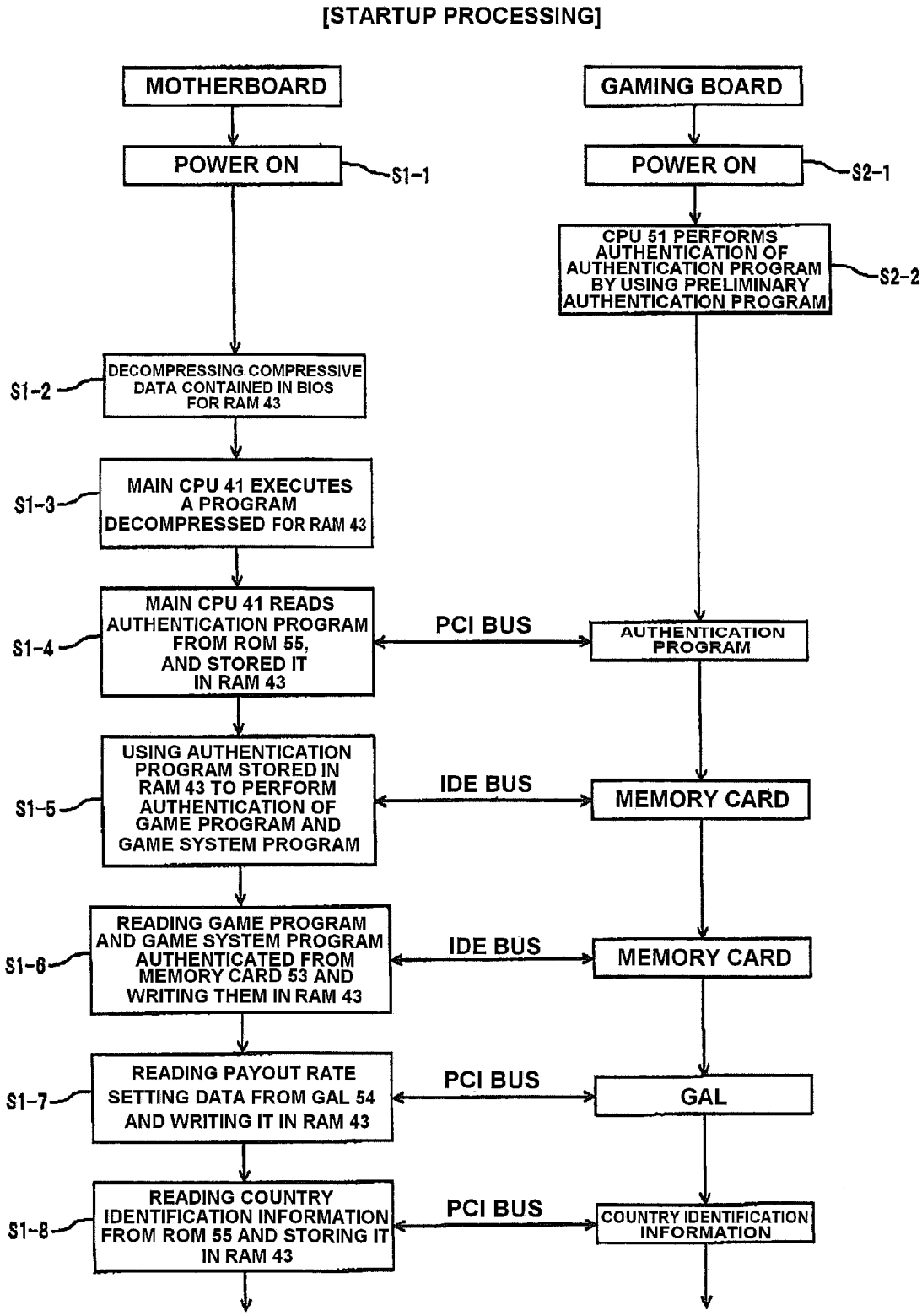
FIG. 19 is a flowchart showing procedures for performing startup processing.

Lastly, startup processing which is invoked at step S110 in the main routine shown in FIG. 9 will be described. FIG. 19 is a flowchart showing procedures for performing startup processing. This processing operation indicates procedures for performing authentication read processing of a game program and a game system program, depending upon the motherboard 40 and the gaming board 50. A memory card 53 is inserted into a card slot 53S provided in the gaming board 50, and a GAL 54 is mounted to an IC socket 54S.

When a power switch is turned ON (power is supplied) in a power unit 45, the motherboard 40 and the gaming board 50 are started up (steps S1-1, S2-1). When they are started up, individual processing operations are performed, respectively. That is, on the gaming board 50, the CPU 51 reads a preliminary authentication program stored in the boot ROM 52. In accordance with the read preliminary authentication program, this CPU performs preliminary authentication to verify and certify in advance that an authentication program is not falsified, before data capturing in the motherboard 40 (step S2-2). On the other hand, on the motherboard 40, the main CPU 41 executes a BIOS stored in the ROM 42, and then, decomposes in the RAM 43 the compressed data incorporated in the BIOS (step S1-2). After that, the main CPU 41 executes the BIOS decompressed in the RAM 43, and diagnoses and initializes various peripheries (step S1-3).

To the main CPU 41, a ROM 55 of the gaming board 50 is connected via a PCI bus. The main CPU 41 performs processing of reading the authentication program stored in the ROM 55 and storing the read authentication program in the RAM 43 (step S1-4). At this time, the main CPU 41 takes a check sum by means of an ADD SUM system (standard check function) in accordance with the standard BIOS functions, and then, causes the RAM 43 to store the authentication program, while performing verification processing of whether or not storing operation is reliably performed without any mistake.

Next, the main CPU 41 provides an access to the memory card 53 inserted into the card slot 53S via an IDE bus after checking to see what is connected to the IDE bus; and reads the game program and the game system program from the memory card 53. In this case, the main CPU 41 reads data constituting the game program and the game system program on a 4-by-4-bytes basis. Subsequently, the main CPU 41 performs authentication to verify and certifies that the read game programs and game system programs are not falsified, in accordance with the authentication program stored in the RAM 43 (steps S1-5). When this authentication processing normally terminates, the main CPU 41 causes the RAM 43 to write and store the (authenticated) game programs and game system programs targeted for authentication (steps S1-6). Next, the main CPU 41 provides an access to the GAL 54 mounted to the IC socket 54S via the PCI bus; reads payout rate setting data; and causes the RAM 43 to write and store the data (steps S1-7). Next, the main CPU 41 performs processing of reading country ID information stored in the ROM 55 of the gaming board 50 and causing the RAM 43 to store the read country ID information (steps S1-8).

After performing such startup processing, the main CPU 41 sequentially reads and executes the game programs and game system programs, thereby conducting the abovementioned game.

As described above, in the embodiment, the number of times of executing a base game is counted, and then, a countdown effect is rendered during a time interval from a time point at which the counted number of times reached the first predetermined value Th1 (for example, 990) to a time point at which it reached the second predetermined value Th2 (for example, 1,000), i.e., a time interval that took until a new game (free game) is started. If the number of times of executing a base game reached the second predetermined value Th2, a game (free game) is started which is performed even if gaming mediums such as coins, bills, or electronic securities information equivalent thereto, are not betted. This free game is a game which the player is allowed to play without need to bet any gaming mediums, and the objective thereof is to return gaming mediums to the players.

Therefore, even if a large number of gaming mediums were consumed by the play of games over a long period of time, the games can be further performed, even if no gaming mediums are betted (i.e., with no charge), by performing them until the game count reaches a specific number of times (the second predetermined value). Accordingly, it is possible to prevent players, who consumed a large number of gaming mediums, from raising discomfort or mistrust to the games or from losing interest or concern relevant to the play of games.

On the common display device 200, the game contents of a free game are explained until a countdown effect is rendered on each of the gaming machines 10. This countdown effect can attract interest or concern of those who do not play games. Further, in a free game, there can be attained an advantageous effect of alleviating the uneasiness of players who have the feeling of uneasiness in playing games for a long time by explaining the fact that gaming mediums might be returned, by way of explanatory image.

While, in the present embodiment, the first predetermined value Th1 is set at 990, and the second predetermined value Th2 is set at 1,000, these predetermined values are not limitative thereto in particular. For example, the first predetermined value may be set at 1 in order to start a countdown effect from an initial state in which an insurance-on mode is established. Further, the predetermined values may be randomly set by the random number value every time transfer to the insurance-on mode is performed.

The free game in the present invention can be designed as required without being limitative in particular, as long as it is performed even if no gaming mediums are betted. The present embodiment defines the rule of the free game as a game (regularly performed in a slot machine) in which a plurality of symbols drawn on the reels 14 are displayed in a stopped state after they are variably displayed, and then, a payment amount is determined according to the symbols displayed in a stopped state or a combination of the displayed symbols. However, the above free game in the present invention is not limitative thereto, and games, which are different from that played by the slot machine, may be performed. For example, card games such as poker or other games such as a shooting game or a martial art game may be performed. At this time, these games may be performed only once, or alternatively, may be repeatedly performed over a plurality of times.

While the present embodiment described a case of using the mechanical reels 14, symbols may be displayed on a display device such as a liquid crystal display device in place of the mechanical reels 14 in the present invention. The above-described embodiments of the present invention merely provide specific examples, and do not limit the invention in particular, and the design of specific features such as means can be modified as required.

Second Embodiment

While, in the first embodiment, a configuration was employed to display an explanatory image of a free game on the common display device 200 while the countdown effect of the free game is not started, a configuration may be employed to display an explanatory image on the common display device 200 until the free game (second game) is started. The configuration of the gaming system according to the present embodiment is completely identical to that shown in the first embodiment, and therefore, a description thereof is omitted.

Figure 20:
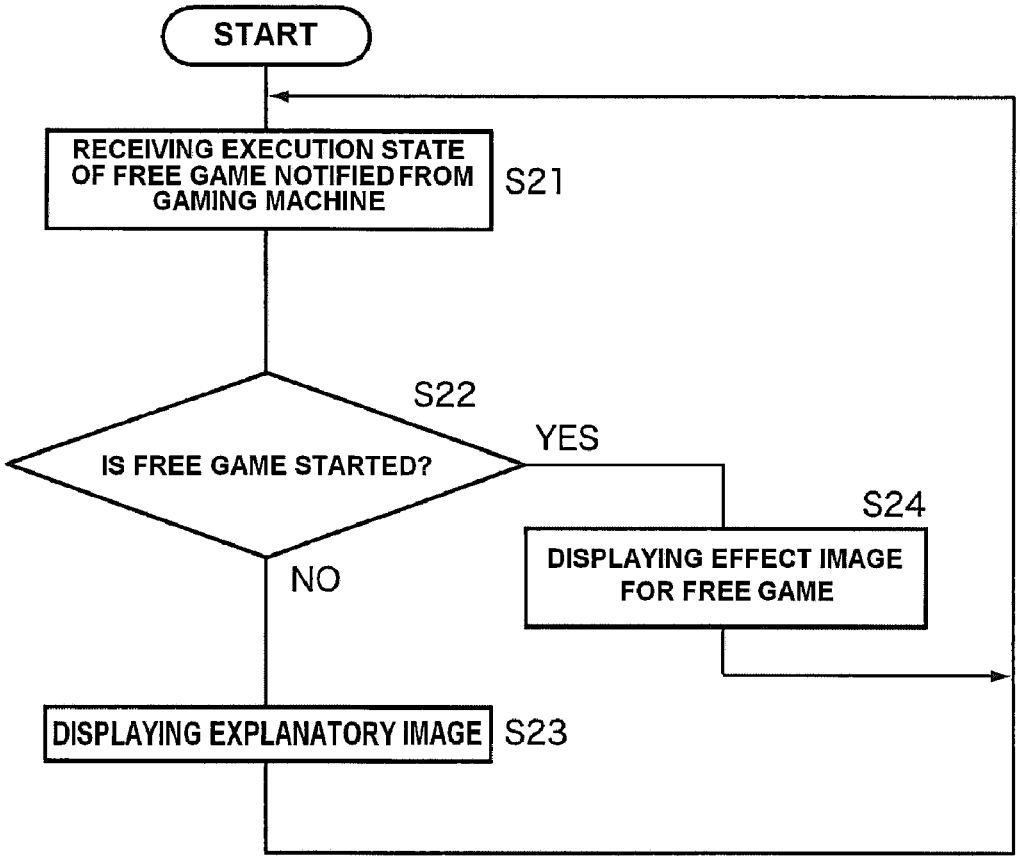
FIG. 20 is a flowchart showing procedures for executing processing in the common display device.

FIG. 20 is a flowchart showing operating procedures performed on the common display device 200. As a state of execution of a free game (second game) in the gaming machine 10, if the common display device 200 receives through the communication interface 201 the total game count C notified from the gaming machine, the CPU 203 of the common display device 200 compares the total game count C executed on each of the gaming machines 10 with the second predetermined value Th2, based upon an identification number for identifying the gaming machine 10, thereby judging whether or not there exists a gaming machine at which the total game number C becomes the second predetermined value Th2. In this manner, it is judged whether or not there exists a gaming machine 10 at which a free game is started (step S22).

If there does not exist a gaming machine 10 at which the total game count becomes the second predetermined value Th2 or more, it is judged that a free game is not started in any of the gaming machines 10 (S22: NO), the CPU 203 reads an explanatory image from the image data ROM 209, causes the video RAM 208 to store the reading, and drives the drive circuit 207 through the VDP 206, thereby displaying the explanatory image 200*b* as shown in FIG. 1 on the liquid crystal display device 210 (step S23).

On the other hand, if there exists a gaming machine 10 at which the total game count C becomes the second predetermined value Th2 or more, it is judged that a free game is started at any of the gaming machines 10 (S23: YES). The CPU 203 reads an effect image for the free game from the image data ROM 209, causes the video RAM 208 to store the reading, and then, drives the drive circuit 207 through the VDP 206, thereby displaying an effect image (not shown) associated with the free game on the liquid crystal display device 210 (step S24).

As described above, on the common display device 200, an explanatory image is displayed until a free game (second game) is started, and, after the free game is started, an effect image for the free game is displayed. Therefore, any image is always displayed on the common display device 200; a period during which the common display device 200 is not used is eliminated, and hardware resources can be effectively utilized.

While, in the present embodiment also, the second game was defined as a free game, it can be applied to any game such that no countdown effect is rendered. Such games can include: a common game, which is started at a predetermined timing or at a randomly determined timing, and in which the players of gaming machines 10 participate; and a second game or the like, which is started while the combinations and number of symbols variably displayed are triggered.

Third Embodiment

While, in the first and second embodiments, a construction was employed to switch an explanatory image and an effect image according to a state of execution of a second game, a configuration may be employed to display an explanatory image of the second game if there exists a gaming machine 10 which is not played by a player. The configuration of the gaming system according to the present embodiment is completely identical to that presented in the first embodiment, and thus. a description thereof is omitted.

Figure 21:
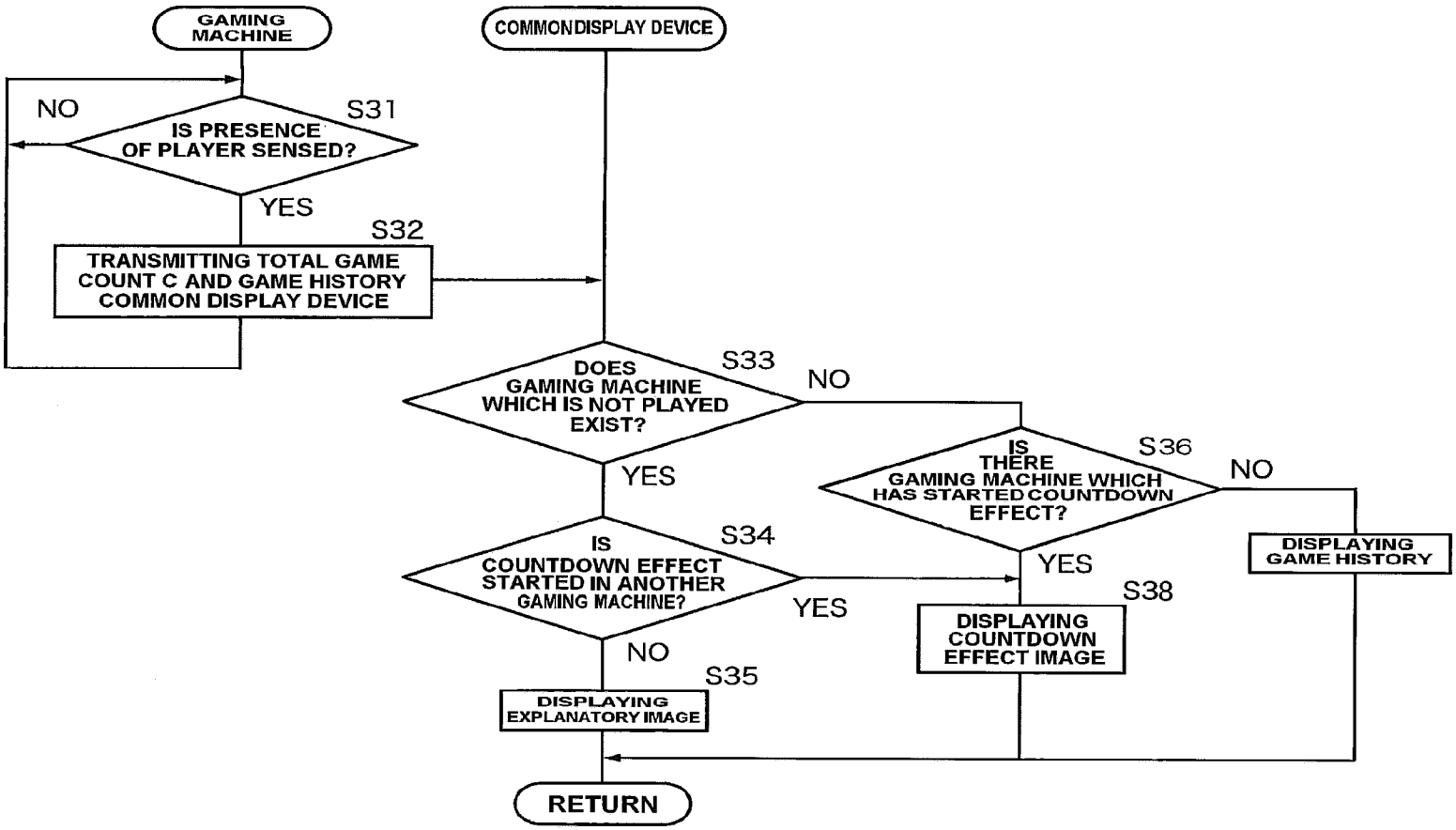
FIG. 21 is a flowchart showing operational procedures executed in a gaming system.

FIG. 21 is a flowchart showing procedures for executing processing in the gaming system 1. First, it is judged whether or not the presence of a player who is playing a game at the gaming machine 10 has been sensed (step S31). The gaming machine 10 is provided with a coin counter 21C for detecting a legitimate coin inserted into a coin insertion slot 21. This coin counter 21C is constituted to output a signal to the main CPU 41 when a legitimate coin has been detected. Thus, the presence or absence of a player who is playing a game can be sensed by the main CPU 41 judging whether or not a signal has been input from the coin counter 21C.

If it is judged that the presence of the player is not sensed at step S31 (S31: NO), the routine reverts to step S31.

Alternatively, if it is judged that the presence of the player has been sensed (S31: YES), the main CPU 41 transmits, to the common display device 200, a game history such as total game count C and accumulative coin entry number, and accumulative payout number, through the communication interface 44 (step S32).

On the common display device 200, based upon notification from each of the gaming machines 10, it is judged whether or not there exists a gaming machine 10 which is not played, among the networked gaming machines 10 (10A to 10D) (step S33).

If it is judged that there exists a gaming machine 10 which is not played (S33: YES), it is judged whether or not a countdown effect is started in another gaming machine (step S34). The judgment of whether or not the countdown effect is started is made by comparison between the total game count C and the first predetermined number Th1 at each of the gaming machines 10, like the first embodiment. If it is judged that the countdown effect is not started in another gaming machine 10 (S34: NO), the CPU 203 of the common display device 200 reads an explanatory image from the image data ROM 209, causes the video RAM 208 to store the reading, and drives the drive circuit 207 through the VDP 206, thereby displaying the explanatory image 200b as shown in FIG. 1 on the liquid crystal display device 210 (step S35).

Alternatively, if it is judged that there does not exist a gaming machine 10 which is not played at step S33, i.e., if it is judged that there exist players who are playing at all of the gaming machines 10, it is judged whether or not there exists a gaming machine 10 which starts a countdown effect, in a manner similar to that described above (step S36). If it is judged that a gaming machine 10, which starts a countdown effect, does not exist (S36: NO), the CPU 203 of the common display device 200 supplies an image generation instruction to the VDP 206, thereby causing the VDP 206 to generate an image for displaying a game history. Then, the video RAM 308 is caused to store the generated image for displaying the game history, and the drive circuit 207 is driven through the VDP 206, whereby the game history at each of the gaming machines 10 is displayed on the liquid crystal display device 210 (step S37).

Figure 22:
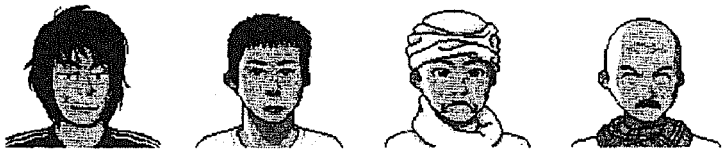
FIG. 22 is a schematic view showing an exemplary game history displayed on the common display device.

FIG. 22 is a schematic view showing an exemplary game history displayed on the common display device 200. In the example shown in FIG. 22, a game count, an accumulative number of coin entries, an accumulative payout number, profit and deficit, and a return rate are displayed as a game history at each of the gaming machines 10.

If it is judged that the countdown effect is started at another gaming machine 10 at step S34 (S34: YES), or alternatively, if it is judged that there exists a gaming machine 10 which starts a countdown effect at step S36 (S36: YES), the CPU 203 reads an explanatory image from the image data ROM 209, causes the video RAM 208 to store the reading, and drives the drive circuit 207 through the VDP 206, thereby displaying the countdown effect image 200*b* as shown in FIG. 1 on the liquid crystal display device 210 (step S38).

As described above, in the present embodiment, if there exists a gaming machine 10 which is not played, an explanation of game is furnished on the common display device 200, thereby making it possible to attract interest and concern of those who does not play a game, and then, urge players to play games. If a new game is introduced, announcement of this game can be performed. In addition, it is possible to compare one's own game history with another player's game history, and thus, for example, it is expected that players are motivated to compete with one another for earlier transfer to a free game, and the players' interest and concern can be maintained. Further, the surrounding spectators can be also aware of the fact that the players compete against each other, so that the amusement place and its periphery are in great bustle and become lively.

While, in the present embodiment, a configuration was employed to sense the presence or absence of a player by means of the coin counter 21C and the main CPU 41, a means for sensing a player is not limitative thereto. For example, the gaming machine 10 is provided with the 1-BET button 26, the MAX-BET button 27, and the spin button 23 depressed at the time of executing a base game. Thus, after signals output from the 1-BET switch 26S, the MAX-BET switch 27S, and the spin switch 23 corresponding thereto are monitored by means of the main CPU 41, if the signals from the switches are not input for a predetermined time (for example, 10 minutes), the fact that a player is absent can be sensed. Further, the gaming machine 10 is provided with a card reader 36 for reading a smart card storing data for identifying players and data concerning a history of games played by players. Thus, the presence or absence of players may be sensed in accordance with the presence or absence of the smart card inserted into the card reader 36. Moreover, a device exclusively used for sensing a player may be additionally provided. As such exclusive device, a pyroelectric infrared sensor is known which senses infrared rays emitted from a human body. The pyroelectric infrared-ray sensor is provided at the appropriate site in front of the gaming machine 10, whereby the presence of a player can be sensed.

Further, advantageous effects described in the embodiments of the present invention are merely exemplified as the most preferable effects derived from the present invention. The advantageous effects according to the present invention are not limitative to those described in the embodiments thereof.

What is claimed is:

1. A gaming system comprising:

a controller; and a plurality of gaming machines and one common display device, which gaming machines and common display device are configured to communicate with each other by means of the controller, the controller being configured to cause:

each of the gaming machines to repeatedly execute a basic game a plurality of times, thereby triggering a second game;

the second game to be executed as a free game a plurality of times; and the common display device to display, while the basic game is being played, one of multiple possible effect images indicating that the second game is about to be executed in one of the gaming machines when the second game has been scheduled to be executed in said one of the gaming machines and an effect image that explains the game-play contents of the second game, wherein each of the gaming machines has associated with it a unique effect image indicating that the second game is about to be executed, and when the second game is about to be executed at more than one of the gaming machines, the unique effect images indicating that the second game is about to be executed and associated with the gaming machines at which the second game is about to be executed are displayed in alternating fashion such that said one of multiple possible effect images that is displayed alternates therebetween, and the common display device is configured to:

receive from each of the gaming machines information indicating whether a player is present at the respective playing machine;

determine whether any of the gaming machines of said plurality of gaming machines is not being played and, if the basic game has been executed less than or equal to the first predetermined number of times in each of the gaming machines and there is at least one gaming machine of said plurality of gaming machines that is not being played, display the effect image that explains the game-play contents of the second game; and display the unique effect image associated with one of the gaming machines and indicating that the second game is about to be executed in said one of the gaming machines when the basic game has been executed in said one of the gaming machines a number of times that is greater than or equal to the first predetermined number of times and less than a second predetermined number of times.

2. The gaming system according to claim 1, wherein the common display device is configured to:

display an effect image associated with the second game actually being executed once the basic game has been executed in one of the gaming machines the second predetermined number of times.

3. A gaming system comprising:

a plurality of gaming machines; and a common display device, which is connected to the gaming machines;

wherein each of the gaming machines has:

a display device, which displays a plurality of symbols;

a gaming machine controller, which executes a process of rearranging symbols arranged on the display device after a gaming medium is betted, and executing a first game of making a payment according to the rearranged symbols and a process of transferring to a second game which is different from the first game when a predetermined condition is met;

a sensing device, which senses presence of a player who is playing a game; and a gaming machine communication interface, which notifies a sensing result by the sensing device to the common display device, wherein the common display device has:

a common display device communication interface, which receives notification from each of the gaming machines;

a memory, which stores an explanatory image explaining game-play contents of the second game; and a common display device controller, which executes a process of judging whether or not there exists a gaming machine which is not played by a player, based upon notification from each of the gaming machines, and a process of displaying the explanatory image stored in the memory, in a case where it is judged that there exists a gaming machine which is not played, wherein each of the gaming machines generates a game history at the respective gaming machine controller so as to notify the generated game history to the common display device through the common display device communication interface; and wherein the common display device displays the game history notified from each of the gaming machines, in a case where it is judged by the common display device controller that there does not exist a gaming machine which is not played.

4. The gaming machine according to claim 3, wherein:

each of the gaming machines notifies an execution state of the second game to the common display device through the common display device communication interface; and the common display device performs at the common display device controller a process of judging whether or not the second game is started at each of the gaming machines and a process of displaying a game history of each of the gaming machines while the second game is not started at each of the gaming machines.

5. A gaming system comprising:

a plurality of gaming machines; and a common display device, which is connected to the gaming machines;

wherein each of the gaming machines has:

a display device, which displays a plurality of symbols;

a gaming machine controller, which executes a process of rearranging symbols arranged on the display device, after a gaming medium is betted, and executing a first game of making a payment according to the rearranged symbols, a process of transferring to a second game which is different from the first game when a predetermined condition is met, and a process of generating a game history;

a sensing device, which senses presence of a player who is playing a game; and a gaming machine communication interface, which notifies an execution state of the second game, the game history generated by the gaming machine controller, and a sensing result by the sensing device to the common display device, and the common display device has:

a common display device communication interface, which receives notification from each of the gaming machines;

a memory, which stores an explanatory image explaining game-play contents of the second game; and a common display device controller, which executes a process of judging whether or not there exists a gaming machine which is not played by a player, based upon notification from each of the gaming machines and whether or not the second game is started, a process of displaying the explanatory image stored in the memory, in a case where it is judged that there exists a gaming machine which is not played, and a process of displaying the game history notified from each of the gaming machines, in a case where it is judged that there does not exist a gaming machine which is not played.

* * * * *